US007576712B2

(12) United States Patent
Takagi et al.

(10) Patent No.: US 7,576,712 B2
(45) Date of Patent: Aug. 18, 2009

(54) PLASMA DISPLAY DEVICE AND METHOD OF DRIVING THE SAME

(75) Inventors: Akihiro Takagi, Kawaguchi (JP); Takashi Sasaki, Hiratsuka (JP); Akira Otsuka, Zama (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 650 days.

(21) Appl. No.: 11/302,520

(22) Filed: Dec. 14, 2005

(65) Prior Publication Data

US 2006/0152167 A1 Jul. 13, 2006

(30) Foreign Application Priority Data

Dec. 15, 2004 (JP) ..... 2004-363314

(51) Int. Cl.
*G09G 3/28* (2006.01)

(52) U.S. Cl. ..... 345/60; 345/61; 345/62; 345/63; 345/204

(58) Field of Classification Search ..... 345/60–63, 345/204
See application file for complete search history.

(56) References Cited

U.S. PATENT DOCUMENTS

2004/0021622 A1* 2/2004 Nagao et al. ..... 345/60
2006/0176246 A1* 8/2006 Shoji et al. ..... 345/60

* cited by examiner

*Primary Examiner*—Richard Hjerpe
*Assistant Examiner*—Leonid Shapiro
(74) *Attorney, Agent, or Firm*—Staas & Halsey LLP

(57) ABSTRACT

The present invention provides a plasma display device including: a plurality of scan electrodes sequentially scanned to be impressed with a scan pulse; an address electrode that is impressed with an address pulse corresponding to the scan pulse, for selection of a display pixel; a scan driving circuit generating the scan pulse; and an address driving circuit generating the address pulse. The address pulse rises in n stages (n is an integer equal to or larger than 2), and a period in a period during which the address pulse rises from a lowest voltage to a highest voltage overlaps a scan pulse immediately prior to the scan pulse corresponding to the address pulse.

8 Claims, 18 Drawing Sheets

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

| | A1 | A2 | A3 | A4 | A5 |
|---|---|---|---|---|---|
| Y1 | ○ | | ○ | | ○ |
| Y2 | | ○ | | ○ | |
| Y3 | ○ | | ○ | | ○ |
| Y4 | | ○ | | ○ | |
| Y5 | ○ | | ○ | | ○ |

PLASMA DISPLAY DEVICE AND METHOD OF DRIVING THE SAME

CROSS-REFERENCE TO RELATED APPLICATIONS

This application is based upon and claims the benefit of priority from the prior Japanese Patent Application No. 2004-363314, filed on Dec. 15, 2004, the entire contents of which are incorporated herein by reference.

BACKGROUND OF THE INVENTION

1. Field of the Invention

The present invention relates to a plasma display device and a method of driving the same.

2. Description of the Related Art

A plasma display is a large flat display and is beginning to be widely used for a wall-mounted television set for home use. For more widespread use, it requires the same level of display quality and price as those of CRT.

SUMMARY OF THE INVENTION

It is an object of the present invention to reduce power consumption for generating an address pulse and to realize stable selection of a display pixel by the address pulse.

According to one aspect of the present invention, provided is a plasma display device including: a plurality of scan electrodes sequentially scanned to be impressed with a scan pulse; and an address electrode that is impressed with an address pulse corresponding to the scan pulse, for selection of a display pixel; a scan driving circuit generating the scan pulse; and an address driving circuit generating the address pulse. The address pulse rises in n stages (n is an integer equal to or larger than 2) and a period in a period during which the address pulse rises from a lowest voltage to a highest voltage overlaps a scan pulse immediately prior to the scan pulse corresponding to the address pulse.

DETAILED DESCRIPTION OF THE PREFERRED EMBODIMENTS

First Embodiment

Figure 1:
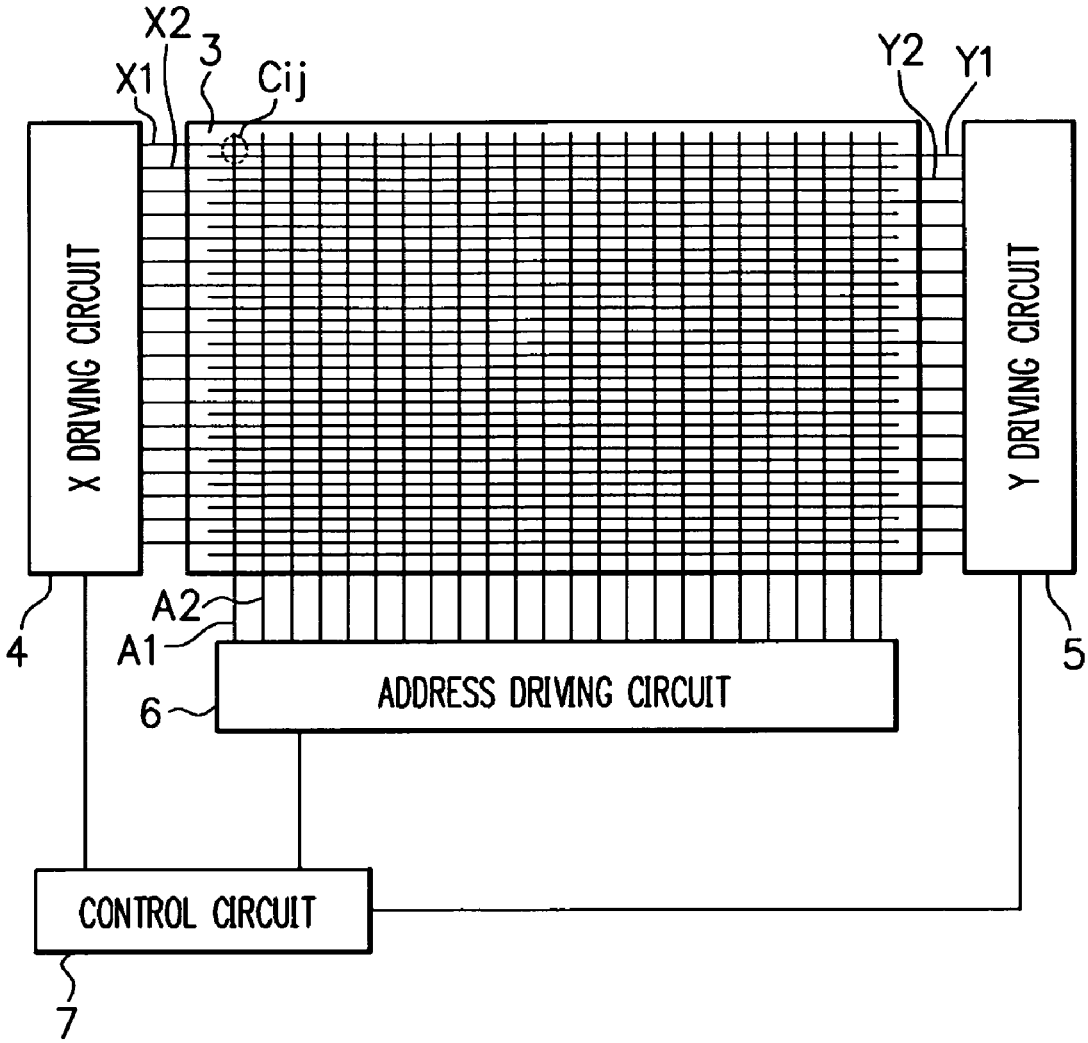
FIG. 1 is a view showing a structural example of a plasma display device according to a first embodiment of the present invention.

FIG. 1 is a view showing a structural example of a plasma display device according to a first embodiment of the present invention. The reference numeral 3 denotes a plasma display panel, the reference numeral 4 an X driving circuit, the reference numeral 5 a Y (scan) driving circuit, the reference numeral 6 an address driving circuit, and the reference numeral 7 a control circuit, respectively.

The control circuit 7 controls the X driving circuit 4, the Y driving circuit 5, and the address driving circuit 6. The X driving circuit 4 supplies a predetermined voltage to a plurality of X electrodes X1, X2, . . . . Hereinafter, an X electrode Xi is used to represent each of the X electrodes X1, X2, . . . or to collectively represent them. "i" is a suffix. The Y driving circuit 5 supplies a predetermined voltage to a plurality of Y (scan) electrodes Y1, Y2, . . . . Hereinafter, a Y electrode Yi is used to represent each of the Y electrodes Y1, Y2, . . . , or to collectively represent them. "i" is a suffix. The address driving circuit 6 supplies a predetermined voltage to a plurality of address electrodes A1, A2, . . . . Hereinafter, an address electrode Aj is used to represent each of the address electrodes A1, A2, . . . or to collectively represent them. "j" is a suffix.

In the panel 3, the Y electrodes Yi and the X electrodes X1 form rows extending in parallel in a horizontal direction, and the address electrodes Aj form columns extending in a vertical direction. The Y electrodes Yi and the X electrodes Xi are alternately arranged in the vertical direction. The Y electrodes Yi and the address electrodes Aj form a two-dimensional matrix of i-rows and j-columns. Each of display cells Cij is formed by an intersection of the Y electrode Yi and the address electrode Aj and the corresponding X electrode Xi adjacent thereto. This display cell Cij corresponds to a pixel, and the panel 3 can display a two-dimensional image.

Figure 2:
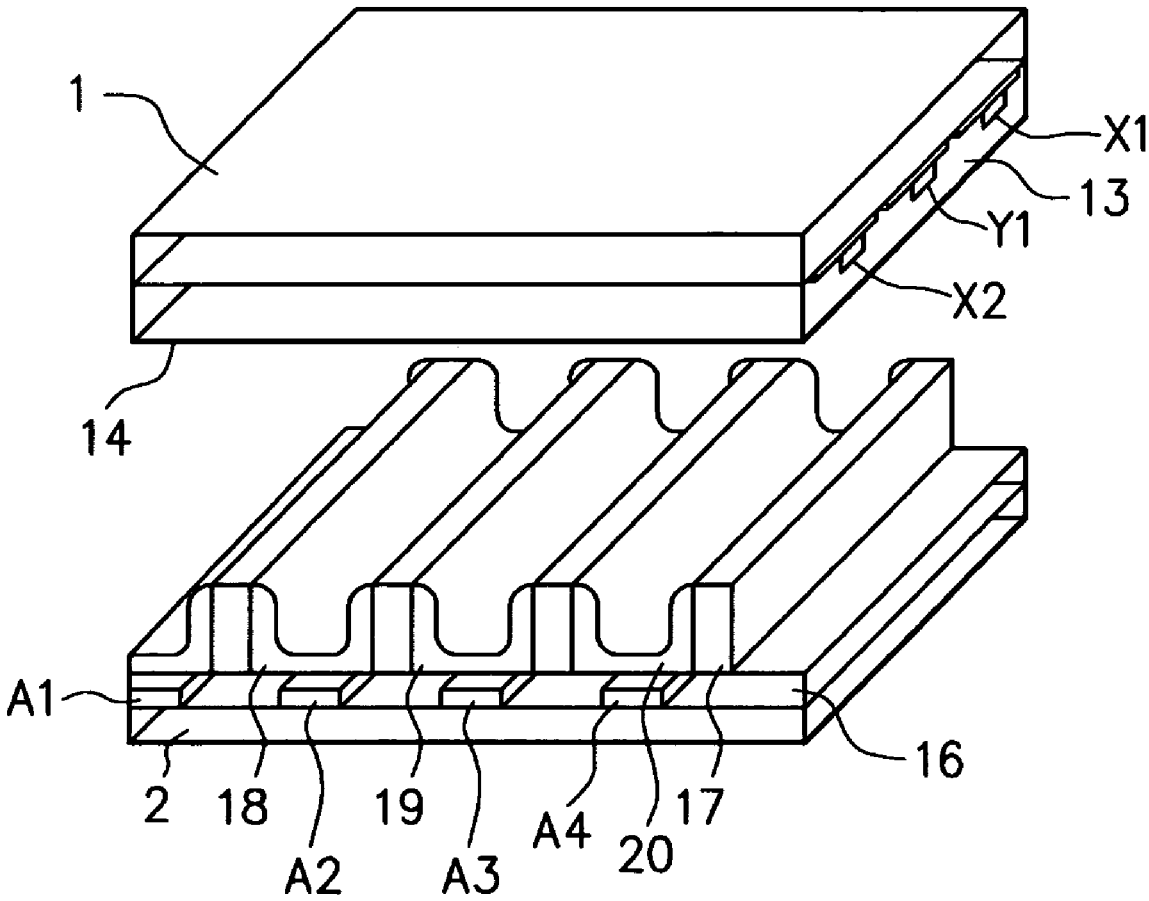
FIG. 2 is an exploded perspective view showing a structural example of a panel according to the first embodiment of the present invention.

FIG. 2 is an exploded perspective view showing a structural example of the panel 3 according to the first embodiment of the present invention. The reference numeral 1 denotes a front glass substrate, the reference numeral 2 a rear glass substrate, the reference numerals 13 and 16 dielectric layers, the reference numeral 14 a protective layer, the reference numeral 17 ribs, and the reference numerals 18 to 20 phosphors, respectively.

The X electrodes Xi and the Y electrodes Yi are formed on the front glass substrate 1 and are covered with the dielectric layer 13 for insulation from a discharge space. The MgO (magnesium oxide) protective layer 14 is further disposed thereon. The address electrodes Aj are formed on the rear glass substrate 2 facing the front glass substrate 1 and are covered with the dielectric layer 16. Further, the phosphors 18 to 20 are disposed thereon. Inner surfaces of the ribs 17 are coated with the phosphors 18 to 20 in red, blue, and green arranged in stripes. The phosphors 18 to 20 are excited by discharge between the X electrodes Xi and the Y electrode Yi to emit lights in the respective colors. The discharge space between the front glass substrate 1 and the rear glass substrate 2 is filled with Ne+Xe penning gas or the like.

Figure 3:
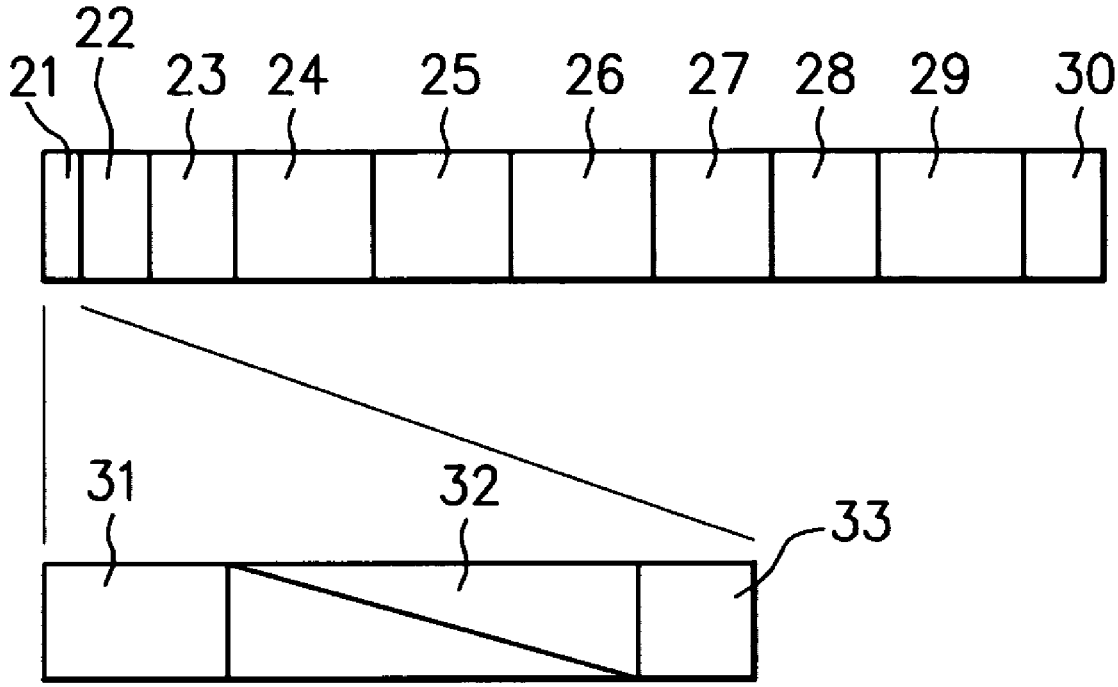
FIG. 3 is a conceptual view showing a structural example of each field according to the first embodiment of the present invention.

FIG. 3 is a conceptual view showing a structural example of each field according to the first embodiment of the present invention. The reference numerals 21 to 30 denote sub-fields, the reference numeral 31 a reset period, the reference numeral 32 an address period, and the reference numeral 33 a sustain period, respectively.

An image is formed at a rate of 60 fields/second, for instance. One field is formed of, for example, the first sub-field 21, the second sub-field 22, . . . , and the tenth sub-field 30. Each of the sub-fields 21 to 30 is made up of the reset period 31, the address period 32, and the sustain (discharge sustain) period 33.

Figure 4:
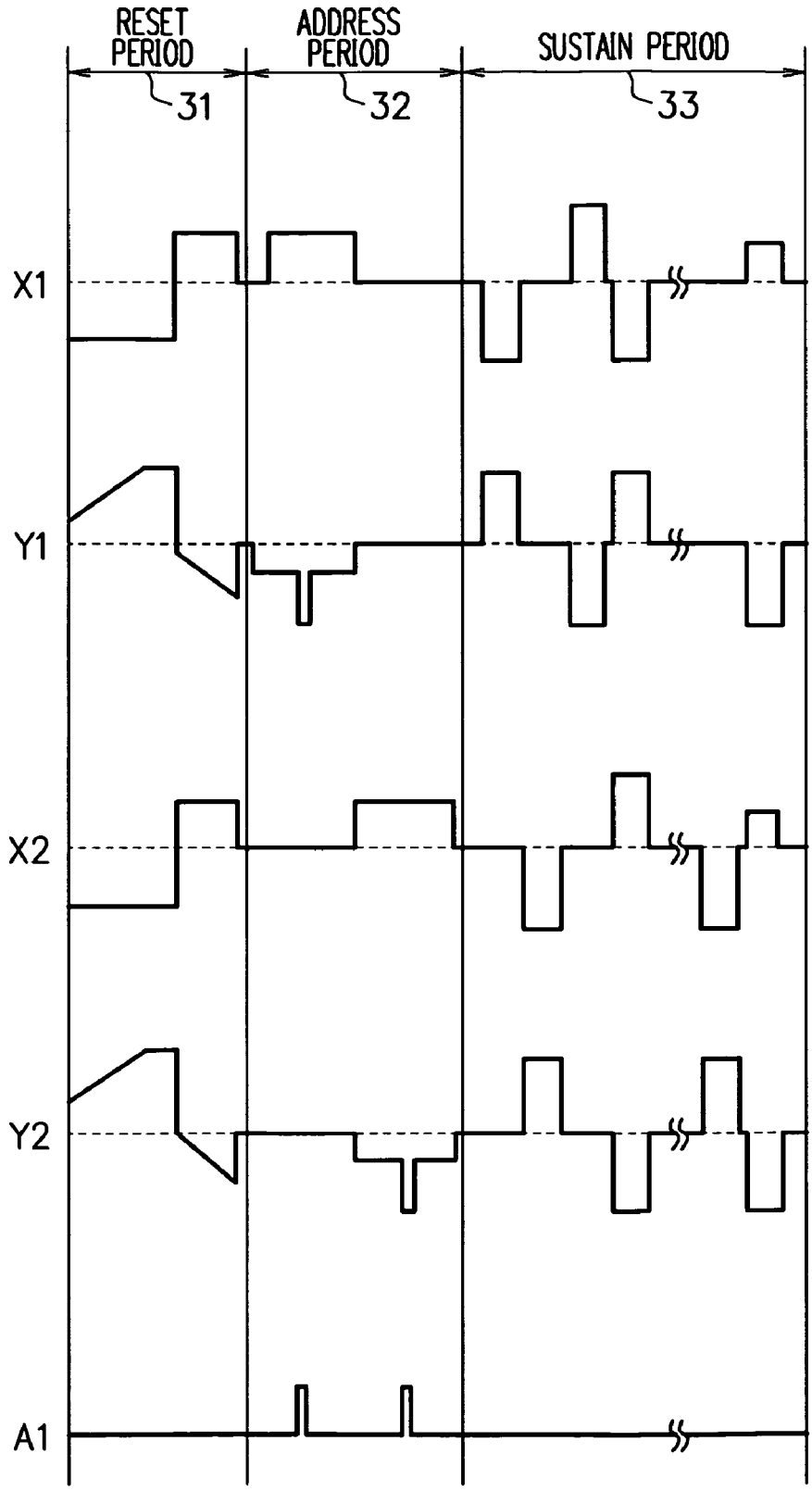
FIG. 4 is a timing chart to illustrate an operational example in a reset period, an address period, and a sustain period.

FIG. 4 is a timing chart to illustrate an operational example in the reset period 31, the address period 32, and the sustain period 33. In the reset period 31, predetermined voltages are applied to the X electrodes Xi and the Y electrodes Yi to initialize the display cells Cij.

In the address period 32, the Y electrodes Y1, Y2, . . . are sequentially scanned to be impressed with a scan pulse, and an address pulse corresponding to the scan pulse is applied to the address electrode Aj, so that a display pixel is selected. If the address pulse to the address electrode Aj is generated in response to the scan pulse to the Y electrode Yi, the display cell of the corresponding Y electrode Yi and X electrode Xi is selected. If the address pulse to the address electrode Aj is not generated in response to the scan pulse to the Y electrode Yi, the display cell corresponding to these Y electrode Yi and X electrode Xi is not selected. When the address pulse is generated in response to the scan pulse, address discharge occurs between the address electrode Aj and the Y electrode Yi, which triggers the occurrence of the discharge between the X electrode Xi and the Y electrode Yi, so that the X electrode Xi is negatively charged and the Y electrode Yi is positively charged.

In the sustain period 33, sustain pulses in reversed phases are impressed to the X electrode Xi and the Y electrode Yi, which causes sustain discharge between the X electrode Xi and the Y electrode Yi corresponding to the selected display cell to cause light emission. The number of the sustain pulses (the length of the sustain period 33) between the X electrode Xi and the Y electrode Yi differs depending on the sub-fields 21 to 30. Whereby, tone values can be determined.

Figure 5:
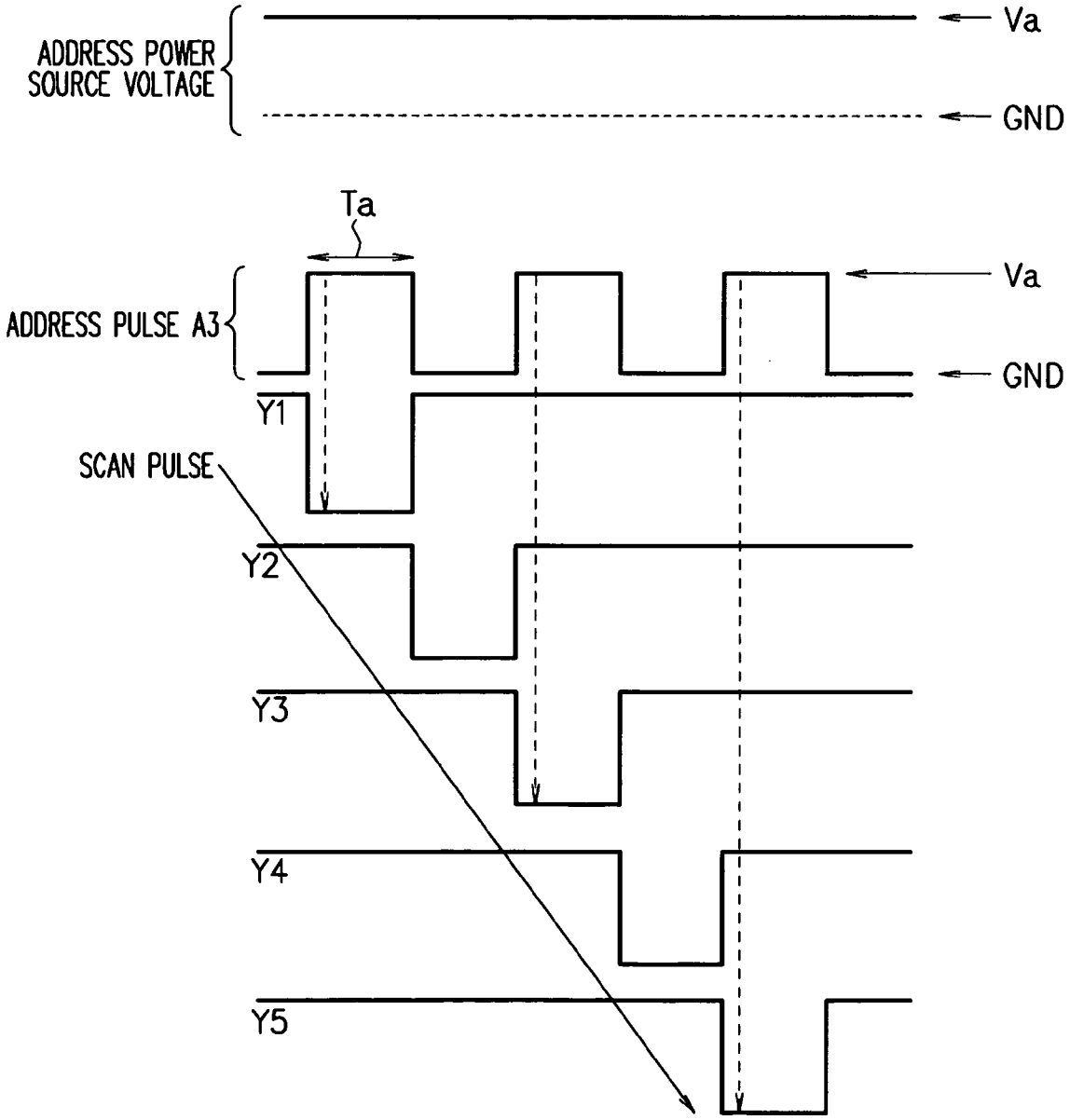
FIG. 5 is a chart showing an address pulse to an address electrode and scan pulses to Y electrodes in the address period.

FIG. 5 is a chart showing an address pulse to the address electrode Aj and scan pulses to the Y electrodes Yi in the address period 32. FIG. 5 shows on the upper portion thereof a two-dimensional matrix of the Y electrodes Y1 to Y5 and the address electrodes A1 to A5. Portions marked with "o" are positions where the address pulses to the address electrodes A1 to A5 are generated and the address discharges occur between the Y electrodes Y1 to Y5 and the address electrodes A1 to A5.

FIG. 5 shows on the lower part thereof the address pulse to the address electrode A3 and the scan pulses to the Y electrodes Y1 to Y5 corresponding to the aforesaid two-dimensional matrix. The scan pulses are negative pulses and are applied to the Y electrodes Y1 to Y5 which are sequentially scanned. The address pulse to the address electrode A3 is generated when the scan pulses are applied to the Y electrodes Y1, Y3, Y5 and are not generated when the scan pulses are applied to the Y electrodes Y2 and Y4. In other words, the address discharges occur due to a potential difference between the scan pulses to the Y electrodes Y1, Y3, Y5 and the address pulse to the address electrode A3, so that the display cells of the Y electrodes Y1, Y3, Y5 are selected and are lighted in the following sustain period 33. This address pulse is a pulse that rises from a lowest voltage (ground GND) to a highest voltage Va in one stage and falls from the highest voltage Va to the lowest voltage (ground GND) in one stage. An address power source voltage for generating this address pulse is the fixed voltage Va relative to the ground GND.

As for the lighting pattern as described above, taking the address electrode A3 for example, when an intersection (A3, Y3) of the address electrode A3 and the Y electrode Y3 is selected, adjacent intersections (A2, Y3) and (A4, Y3) are not selected. Because of this, line-to-line capacitances are observed between the address electrodes A2-A3 and between the address electrodes A3-A4. Further, due to ON/OFF repetition of the address electrode A3 itself, namely, ON of the intersection (A3, Y1), OFF of the intersection (A3, Y2), and so on, the address power source voltage requires large power consumption. Here, reducing the number of the sub-fields can reduce power consumption, though deteriorating image quality.

Figure 6:
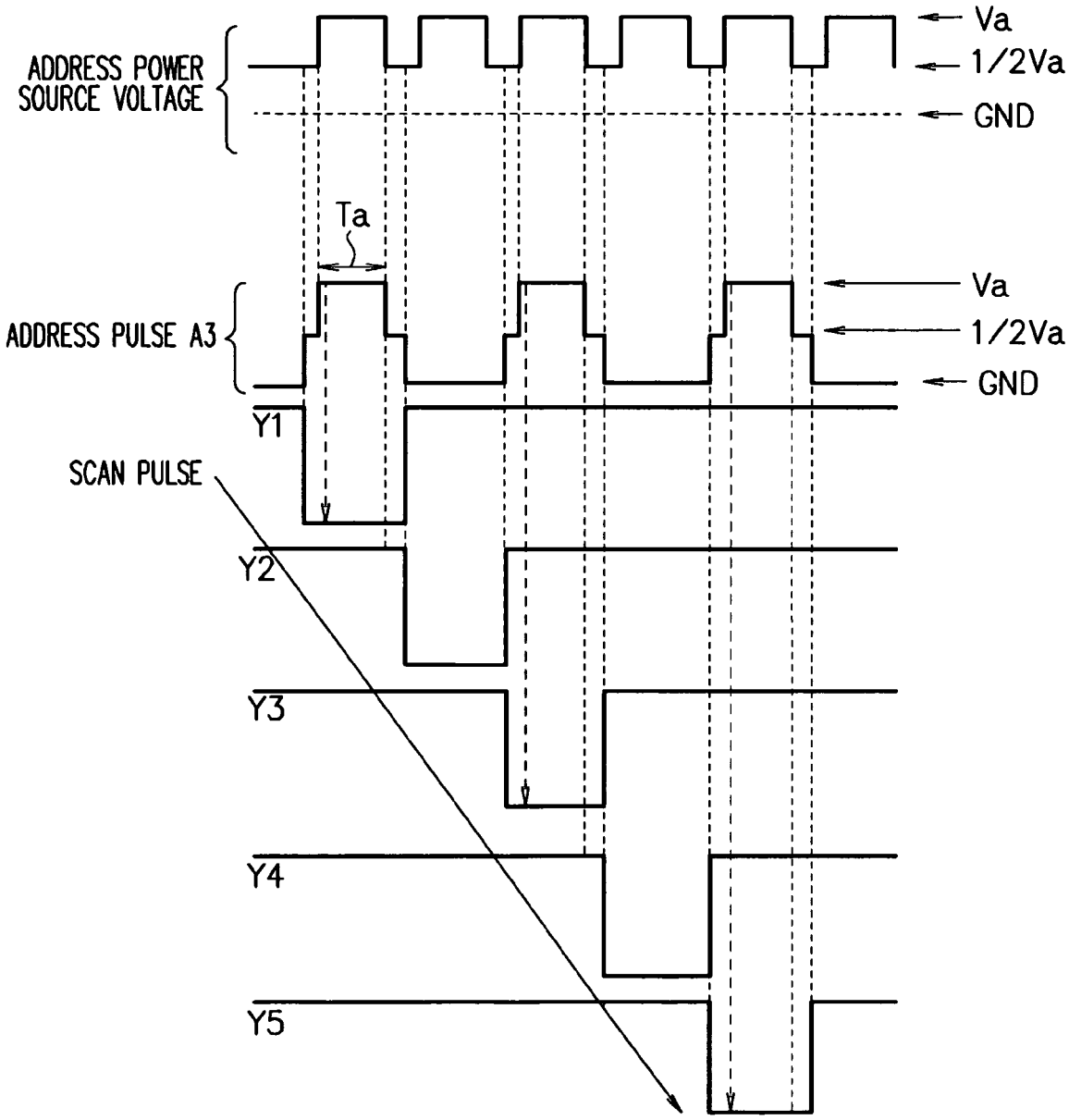
FIG. 6 is a chart showing an address pulse to the address electrode and scan pulses to the Y electrodes for reducing power consumption.

FIG. 6 is a chart showing an address pulse to the address electrode Aj and scan pulses to the Y electrodes Yi for reducing power consumption. In this drawing, the address pulse to the address electrode Aj is different from that shown in FIG. 5. For example, the address pulse to the address electrode A3 is a pulse that rises from the lowest voltage (ground GND) to the highest voltage Va in two stages and falls from the highest voltage Va to the lowest voltage (ground GND) in two stages. Specifically, it rises from the ground GND to a voltage Va/2 and further rises from the voltage Va/2 to the voltage Va. Then, it falls from the voltage Va to the voltage Va/2 and further falls from the voltage Va/2 to the ground GND. The address power source voltages for generating this address pulse are pulse voltages that are the voltage Va and Va/2 relative to the ground GND.

The power consumption for this address pulse will be described. Power consumption P is expressed as $P=CV^2/2$. In the case of FIG. 5, the voltage of the address pulse is Va, and therefore, the power consumption P is $CVa^2/2$.

Next, power consumption in the case of FIG. 6 will be described. Power consumption P at each stage is expressed as P=C×(displacement voltage)×(reached voltage)/2. Power consumption P1 at the time of the first-stage rise from the ground GND to the voltage Va/2 is $P1=C\times(Va/2)\times(Va/2)/2=CV^2/8$. Power consumption P2 at the second-stage rise from the voltage Va/2 to the voltage Va is $P2=C\times(Va/2)\times Va/2=CVa^2/4$. Power consumption P3 at the first-stage fall from the voltage Va to the voltage Va/2 is $P3=C\times(Va/2)\times(Va/2)/2=CVa^2/8$. Here, a power recovery circuit recovers the power P3 at the first-stage fall, and the recovered power P3 is used as the power P1 and the power P2 consumed for the first- and second-stage rises. The second-stage fall from the voltage Va/2 to the ground GND does not consume power since the address electrode A3 is connected to the ground GND to be clamped. Total power consumption P of one address pulse is $P=P1+P2-P3=CVa^2 4$.

Therefore, the power consumption of the two-stage address pulse in FIG. 6 is half the power consumption of the one-stage address pulse in FIG. 5. The power recovery circuit will be described later in detail with reference to FIG. 16 and so on.

As described above, the two-stage rise and fall of the address pulse make it possible to reduce power consumption. However, in the case of FIG. 6, a period Ta during which the address pulse sustains the highest voltage Va is shorter than that in FIG. 5, which gives rise to a problem that stable address discharge is not possible.

Figure 7:
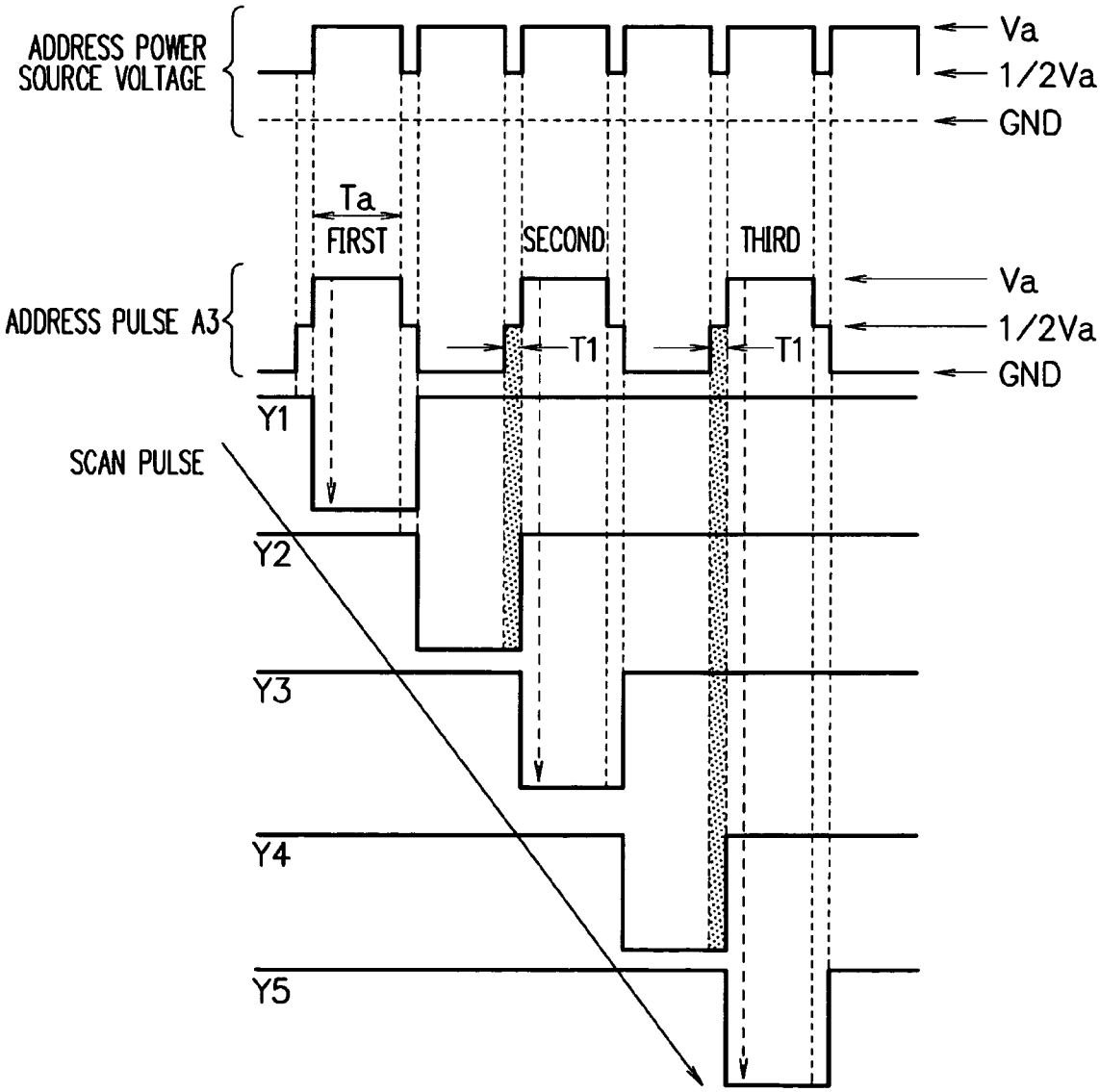
FIG. 7 is a chart showing an address pulse to the address electrode and scan pulses to the Y electrodes according to the first embodiment of the present invention.

FIG. 7 is a chart showing an address pulse to the address electrode Aj and scan pulses to the Y electrodes Yi according to the first embodiment of the present invention. In this drawing, the timing of the two-stage address pulse is different from that in FIG. 6. As an example, the address pulse to the address electrode A3 corresponding to the scan pulse to the Y electrode Y3 will be described. In a period T1 of the scan pulse to the Y electrode Y2 immediately prior to the scan pulse to the Y electrode Y3, the address pulse rises from the ground GND to the voltage Va/2 and sustains the voltage Va/2. Thereafter, when the scan pulse to the Y electrode Y3 falls, the address pulse rises from the voltage Va/2 to the voltage Va to sustain the voltage Va. Thereafter, the address pulse falls from the voltage Va to the voltage Va/2 and sustains the voltage Va/2. Thereafter, when the address pulse falls from the voltage Va/2 to the ground GND, the scan pulse to the Y electrode Y3 rises.

The address pulse rises and falls in two stages as in FIG. 6. The first-stage rise to the voltage Va/2 takes place while the scan pulse to the Y electrode Y2 immediately prior to the scan pulse to the Y electrode Y3 is in the selection state. The second-stage rise to the voltage Va takes place while the scan pulse to the Y electrode Y3 is in the selection state. The first-stage fall to the voltage Va/2 takes place while the scan pulse to the Y electrode Y3 is in the selection state. The second-stage fall to the ground GND takes place while the scan pulse to the Y electrode Y3 is in the selection state.

This address pulse is intended for causing the address discharge by a potential difference from the Y electrode Y3. The period T1 during which the address pulse sustains the voltage Va/2 one-stage higher than the lowest voltage GND overlaps a period of the scan pulse to the Y electrode Y2 immediately prior to the scan pulse to the Y electrode Y3 corresponding to the address pulse. Consequently, a period Ta during which the address pulse sustains the highest voltage Va becomes longer than that in FIG. 6, allowing stable address discharge. Moreover, as in FIG. 6, the two-stage address pulse makes it possible to reduce power consumption. Incidentally, in the period T1, the voltage Va2 of the address pulse is low, so that no erroneous address discharge occurs to the Y electrode Y2. Therefore, according to this embodiment, reduction in power consumption in the address period and stable address discharge are both achieved.

Second Embodiment

Figure 8:
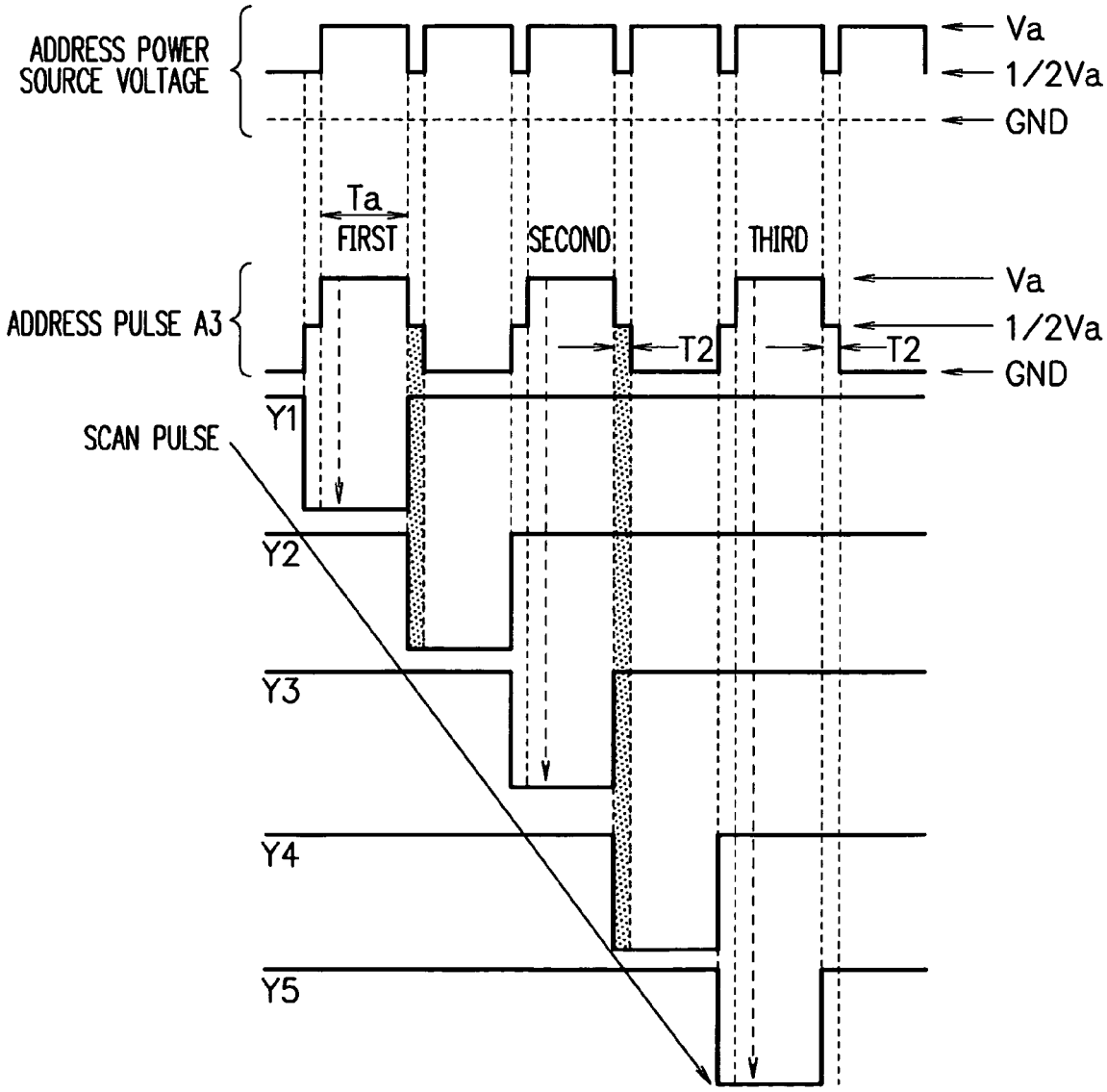
FIG. 8 is a chart showing an address pulse to an address electrode and scan pulses to Y electrodes according to a second embodiment of the present invention.

FIG. 8 is a chart showing an address pulse to an address electrode Aj and scan pulses to Y electrodes Yi according to a second embodiment of the present invention. In this drawing, the timing of a two-stage address pulse is different from that in FIG. 7. As an example, an address pulse to an address electrode A3 corresponding to a scan pulse to a Y electrode Y3 will be described. When the scan pulse to the Y electrode Y3 falls, the address pulse rises from a ground GND to a voltage Va/2 and sustains the voltage Va/2. Thereafter, the address pulse rises from the voltage Va/2 to a voltage Va and sustains the voltage Va. When the address pulse thereafter falls from the voltage Va to the voltage Va/2, the scan pulse to the Y electrode Y3 rises. Thereafter, the address pulse falls from the voltage Va/2 to the ground GND. In other words, in a period T2 of the scan pulse to a Y electrode Y4 immediately subsequent to the scan pulse to the Y electrode Y3, the address pulse sustains the voltage Va/2 and falls to the ground GND.

The address pulse rises and falls in two stages as in FIG. 7. The first-stage rise to the voltage Va/2 takes place while the scan pulse to the Y electrode Y3 is in a selection state. The second-stage rise to the voltage Va takes place while the scan pulse to the Y electrode Y3 is in the selection state. The first-stage fall to the voltage Va/2 takes place while the scan pulse to the Y electrode Y3 is in the selection state. The second-stage fall to the ground GND takes place while the immediately subsequent scan pulse to the Y electrode Y4 is in the selection state.

This address pulse is intended for causing the address discharge by a potential difference from the scan pulse to the Y electrode Y3. The period during which the address pulse sustains the voltage Va/2 one-stage higher than the lowest voltage GND at its fall time overlaps the period T2 of the scan pulse to the Y electrode Y4 immediately subsequent to the scan pulse to the Y electrode Y3 corresponding to the address pulse. Consequently, a period Ta during which the address pulse sustains the highest voltage Va becomes longer, allowing stable address discharge. Further, as in FIG. 7, the two-stage address pulse makes it possible to reduce power consumption. Incidentally, in the period T2, since the voltage Va/2 of the address pulse is low, no erroneous address discharge occurs to the Y electrode Y4. Therefore, according to this embodiment, reduction in power consumption in the address period and stable address discharge are both achieved.

Third Embodiment

Figure 9:
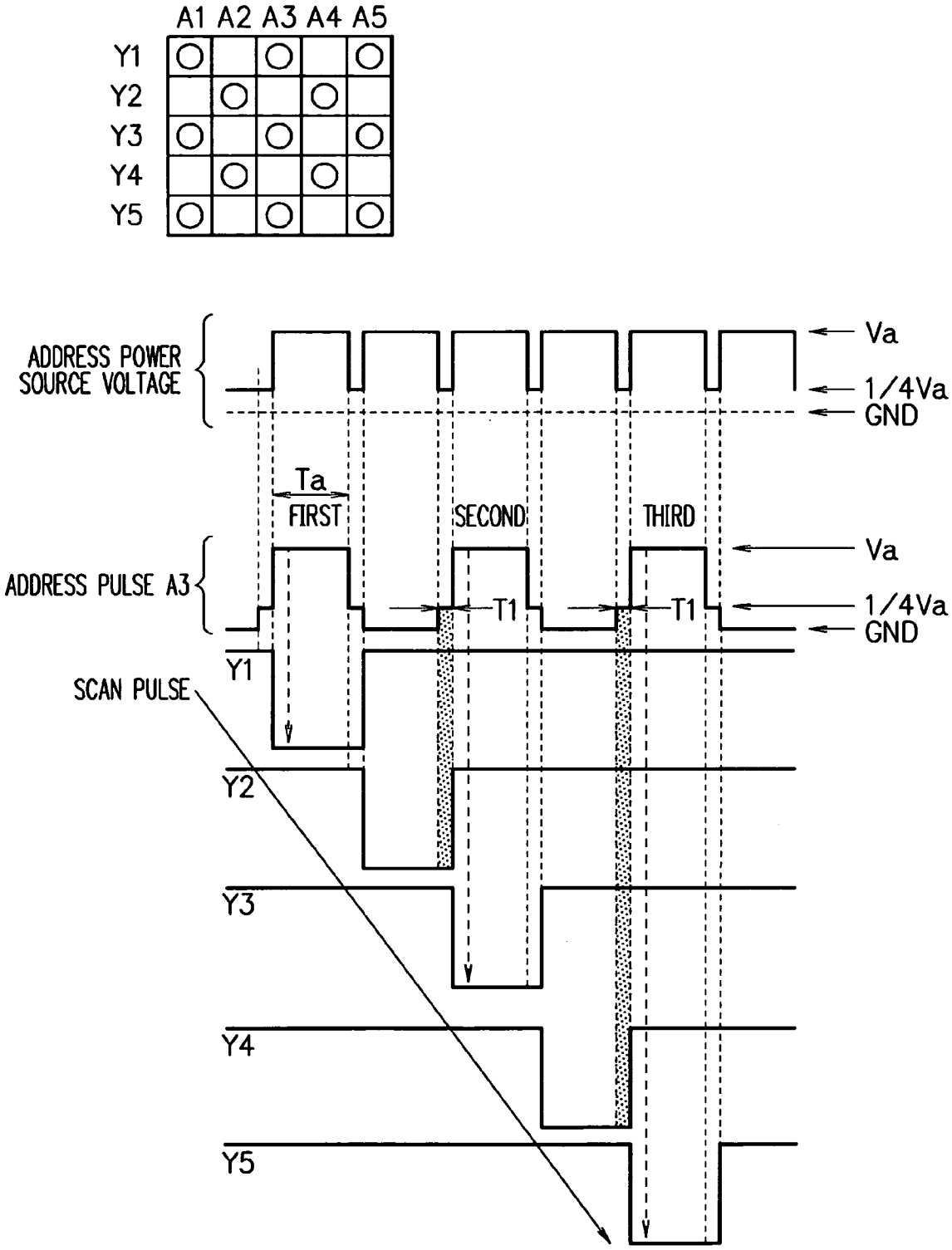
FIG. 9 is a chart showing an address pulse to an address electrode and scan pulses to Y electrodes according to a third embodiment of the present invention.

FIG. 9 is a chart showing an address pulse to an address electrode Aj and scan pulses to Y electrodes Yi according to a third embodiment of the present invention. In this drawing, a voltage of a two-stage address pulse is different from that in FIG. 7. In FIG. 7, the address pulse rises and falls in two stages, and the voltage Va/2 one-stage higher than the lowest voltage GND is about ½ of the highest voltage Va. In this embodiment, the address pulse rises and falls in two stages and a voltage Va/4 one-stage higher than a lowest voltage GND is less than ½ of a highest voltage Va.

As an example, a case where address discharge is caused by a potential difference between an address pulse to an address electrode A3 and a scan pulse to a Y electrode Y3 will be described. In a period T1 of a scan pulse to a Y electrode Y2 immediately prior to the scan pulse to the Y electrode Y3, the address pulse rises from the ground GND to the voltage Va/4 and sustains the voltage Va/4. Thereafter, when the scan pulse to the Y electrode Y3 falls, the address pulse rises from the voltage Va/4 to the voltage Va and sustains the voltage Va. Thereafter, the address pulse falls from the voltage Va to the voltage Va/4 and sustains the voltage Va/4. Thereafter, when the address pulse falls from the voltage Va/4 to the ground GND, the scan pulse to the Y electrode Y3 rises.

According to this embodiment, as in the first embodiment, reduction in power consumption in the address period and stable address discharge are both achieved. In the period T1 of the first embodiment, the voltage of the address pulse is Va/2. Due to variation in a surface of the panel, a voltage value of the discharge between the address electrode and the Y electrode sometimes differs depending on each display cell. This involves a possibility that some display cell performs address discharge erroneously even at the voltage Va/2. Therefore, in the period T1 of this embodiment, the voltage of the address pulse is set to a still lower value, namely, Va/4, which can prevent the occurrence of erroneous address discharge to the Y electrode Y2.

Fourth Embodiment

Figure 10:
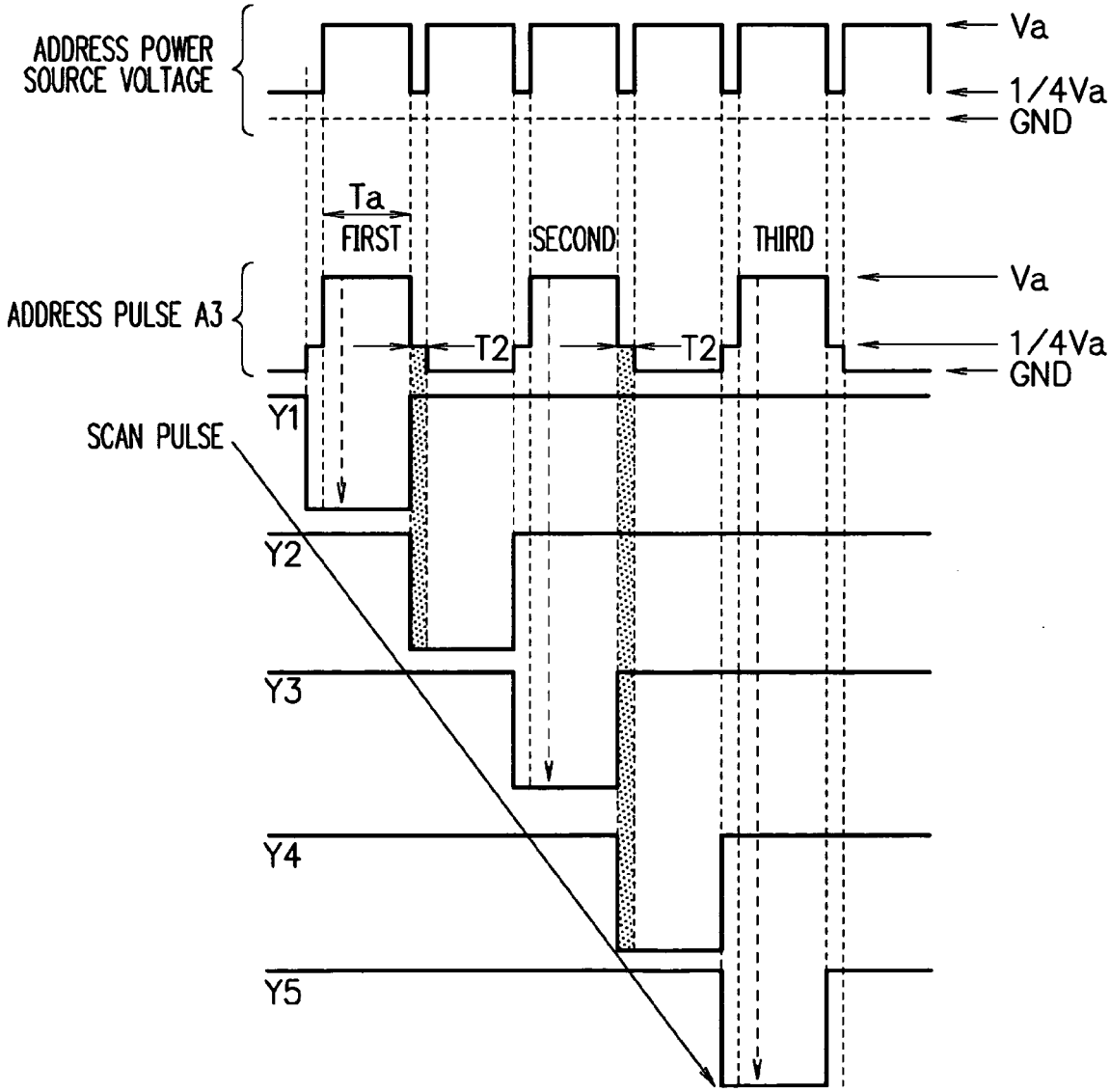
FIG. 10 is a chart showing an address pulse to an address electrode and scan pulses to Y electrodes according to a fourth embodiment of the present invention.

FIG. 10 is a chart showing an address pulse to an address electrode Aj and scan pulses to Y electrodes Yi according to a fourth embodiment of the present invention. In this drawing, a voltage of a two-stage address pulse is different from that in FIG. 8. In FIG. 8, the address pulse rises and falls in two stages and the voltage Va/2 one-stage higher than the lowest voltage GND is about ½ of the highest voltage Va. In this embodiment, the address pulse rises and falls in two stages, and a voltage Va/4 one-stage higher than a lowest voltage GND is less than ½ of a highest voltage Va.

As an example, a case where address discharge is caused by a potential difference between an address pulse to an address electrode A3 and a scan pulse to a Y electrode Y3 will be described. When the scan pulse to the Y electrode Y3 falls, the address pulse rises from the ground GND to the voltage Va/4 and sustains the voltage Va/4. Thereafter, the address pulse rises from the voltage Va/4 to the voltage Va and sustains the voltage Va. When the address pulse thereafter falls from the voltage Va to the voltage Va/4, the scan pulse to the Y electrode Y3 rises. Thereafter, the address pulse falls from the voltage Va/4 to the ground GND. In other words, in a period T2 of a scan pulse to a Y electrode Y4 immediately subsequent to the scan pulse to the Y electrode Y3, the address pulse sustains the voltage Va/4 and falls to the ground GND.

According to this embodiment, as in the second embodiment, reduction in power consumption in the address period and stable address discharge are both achieved. In the period T2 of the second embodiment, the voltage of the address pulse is Va/2. Due to variation in the surface of the panel, a voltage value of discharge between the address electrode and the Y electrode sometimes differs depending on each display cell. This involves a possibility that some display cell performs address discharge erroneously even at the voltage Va/2. Therefore, in the period T2 of this embodiment, the voltage of the address pulse is set to a still lower value, namely, Va/4, which makes it possible to prevent the occurrence of erroneous address discharge to the Y electrode Y4.

Fifth Embodiment

Figure 11:
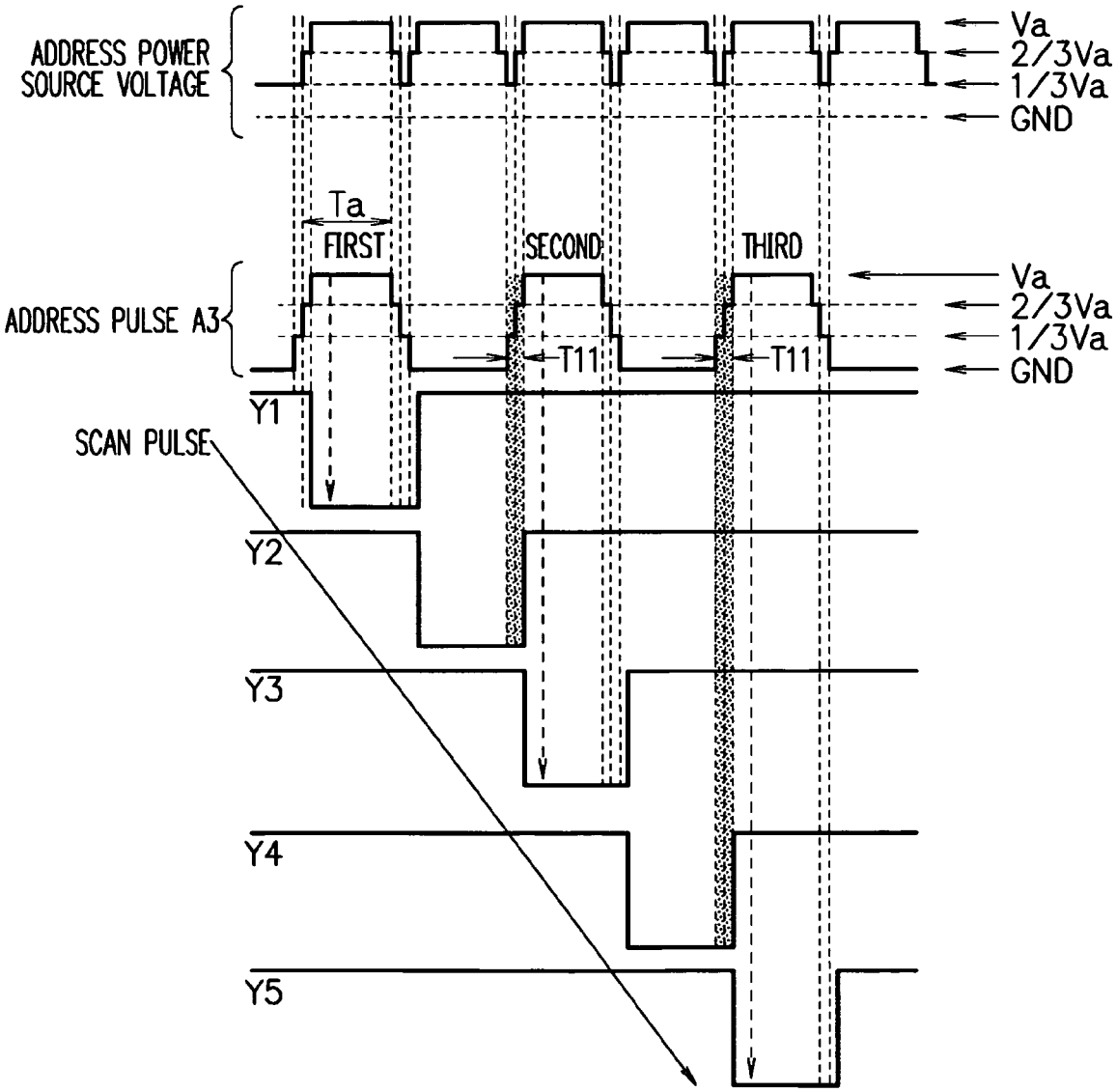
FIG. 11 is a chart showing an address pulse to an address electrode and scan pulses to Y electrodes according to a fifth embodiment of the present invention.

FIG. 11 is a chart showing an address pulse to an address electrode Aj and scan pulses to Y electrodes Yi according to a fifth embodiment of the present invention. This drawing is different from FIG. 7 in that the address pulse is a three-stage address pulse. In FIG. 7, the address pulse rises and falls in two stages, but in this embodiment, the address pulse rises and falls in three stages.

As an example, an address pulse to an address electrode A3 corresponding to a scan pulse to a Y electrode Y3 will be described. In a period T11 of a scan pulse to a Y electrode Y2 immediately prior to the scan pulse to the Y electrode Y3, the address pulse rises from a ground GND to a voltage Va/3, sustains the voltage Va/3, rises from the voltage Va/3 to a voltage 2Va/3, and sustains the voltage 2Va/3. When the scan pulse to the Y electrode Y3 thereafter falls, the address pulse rises from the voltage 2Va/3 to a voltage Va and sustains the voltage Va. Thereafter, the address pulse falls from the voltage Va to the voltage 2Va/3 and sustains the voltage 2Va/3. Thereafter, the address pulse falls from the voltage 2Va/3 to the voltage Va/3 and sustains the voltage Va/3. Thereafter, the address pulse falls from the voltage Va/3 to the ground GND. Thereafter, the scan pulse to the Y electrode Y3 rises.

The period T11 during which the address pulse rises from the lowest voltage GND to the voltage 2Va/3 one-stage lower than the highest voltage Va overlaps the scan pulse to the Y electrode Y2 immediately prior to the scan pulse to the Y electrode Y3 corresponding to the address pulse. Consequently, a period Ta during which the address pulse sustains the highest voltage Va is made longer, allowing stable address discharge. Incidentally, in the period T11, the voltage Va/3 or 2Va/3 of the address pulse is low, and therefore no erroneous address discharge occurs to the Y electrode Y2. Therefore, according to this embodiment, as in the first embodiment, reduction in power consumption in the address period and stable address discharge are both achieved. Moreover, the three-stage address pulse of this embodiment contributes more to the reduction in power consumption than the two-stage address pulse of the first embodiment.

Sixth Embodiment

Figure 12:
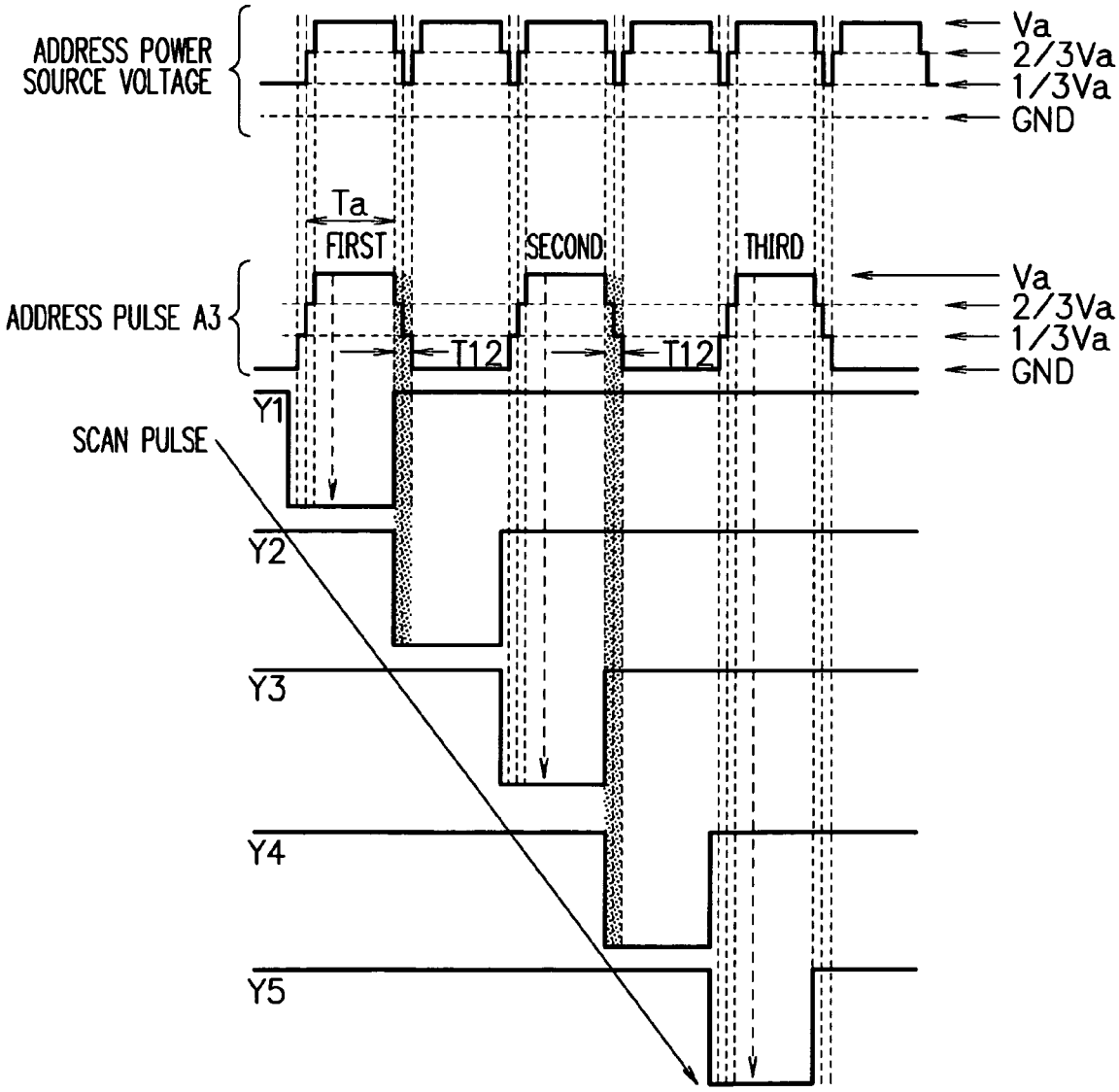
FIG. 12 is a chart showing an address pulse to an address electrode and scan pulses to Y electrodes according to a sixth embodiment of the present invention.

FIG. 12 is a chart showing an address pulse to an address electrode Aj and scan pulses to Y electrodes Yi according to a sixth embodiment of the present invention. In this drawing, the timing of a three-stage address pulse is different from that in FIG. 11. In FIG. 11, the rise timing of the address pulse overlaps the scan pulse immediately prior thereto, but in this embodiment, the fall timing of the address pulse overlaps a scan pulse immediately subsequent thereto.

As an example, an address pulse to an address electrode A3 corresponding to a scan pulse to a Y electrode Y3 will be described. When the scan pulse to the Y electrode Y3 falls, the address pulse rises from a ground GND to a voltage Va/3 and sustains the voltage Va/3. Thereafter, the address pulse rises from the voltage Va/3 to a voltage 2Va/3 and sustains the voltage 2Va/3. Thereafter, the address pulse rises from the voltage 2Va/3 to a voltage Va and sustains the voltage Va. When the address pulse thereafter falls from the voltage Va to the voltage 2Va/3, the scan pulse to the Y electrode Y3 rises. Thereafter, the address pulse falls from the voltage 2Va/3 to the voltage Va/3 and sustains the voltage Va/3. Thereafter, the address pulse falls from the voltage Va/3 to the ground GND and sustains the ground GND.

A period T12 during which the address pulse sustains the voltage 2Va/3 one-stage lower than the highest voltage Va at its fall time and falls from the voltage 2Va/3 to the lowest voltage GND overlaps a scan pulse to a Y electrode Y4 immediately subsequent to the scan pulse to the Y electrode Y3 corresponding to the address pulse. Consequently, a period Ta during which the address pulse sustains the highest voltage Va becomes longer, allowing stable address discharge. Incidentally, in the period T12, the voltage Va/3 or 2Va/3 of the address pulse is low, so that no erroneous address discharge occurs to the Y electrode Y4. Therefore, according to this embodiment, as in the fifth embodiment, the three-stage address pulse makes it possible to achieve both reduction in power consumption and stable address discharge.

Seventh Embodiment

Figure 13:
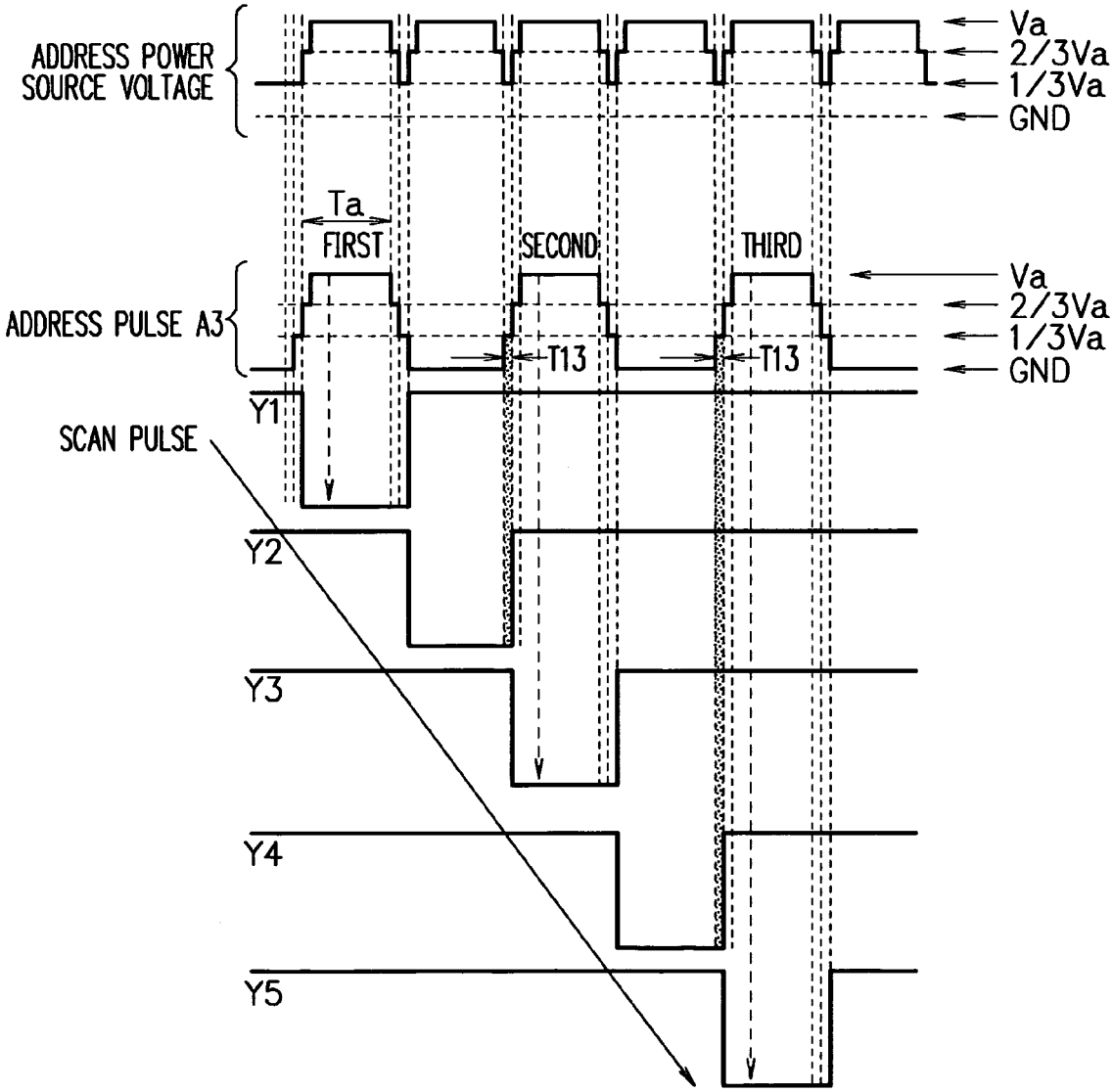
FIG. 13 is a chart showing an address pulse to an address electrode and scan pulses to Y electrodes according to a seventh embodiment of the present invention.

FIG. 13 is a chart showing an address pulse to an address electrode Aj and scan pulses to Y electrodes Yi according to a seventh embodiment of the present invention. In this drawing, the timing of a three-stage address pulse is different from that in FIG. 11. In FIG. 11, the period T11 during which the address pulse rises overlaps the scan pulse to the Y electrode Y2, but in this embodiment, a period T13 during which an address pulse to an address electrode A3 sustains a voltage Va/3 one-stage higher than a lowest voltage GND overlaps a scan pulse to a Y electrode Y2 immediately prior to the scan pulse to the Y electrode Y3 corresponding to the address pulse.

As an example, the address pulse to the address electrode A3 corresponding to the scan pulse to the Y electrode Y3 will be described. In the period T13 of the scan pulse to the Y electrode Y2 immediately prior to the scan pulse to the Y electrode Y3, the address pulse rises from the ground GND to a voltage Va/3 and sustains the voltage Va/3. When the scan pulse to the Y electrode Y3 thereafter falls, the address pulse rises from the voltage Va/3 to a voltage 2Va/3 and sustains the voltage 2Va/3. Thereafter, the address pulse rises from the voltage 2Va/3 to a voltage Va and sustains the voltage Va. Thereafter, the address pulse falls from the voltage Va to the voltage 2Va/3 and sustains the voltage 2Va/3. Thereafter, the address pulse falls from the voltage 2Va/3 to the voltage Va/3 and sustains the voltage Va/3. Thereafter, the address pulse falls from the voltage Va/3 to the ground GND. Thereafter, the scan pulse to the Y electrode Y3 rises.

The period T13 during which the address pulse sustains the voltage Va/3 one-stage higher than the lowest voltage GND overlaps the scan pulse to the Y electrode Y2 immediately prior to the scan pulse to the Y electrode Y3 corresponding to the address pulse. Consequently, a period Ta during which the address pulse sustains the highest voltage Va is made longer, allowing stable address discharge. Incidentally, in the period T13, the voltage Va/3 of the address pulse is low, so that no erroneous address discharge occurs to the Y electrode Y2. Therefore, according to this embodiment, as in the fifth embodiment, the three-stage address pulse makes it possible to achieve both reduction in power consumption and stable address discharge.

Eighth Embodiment

Figure 14:
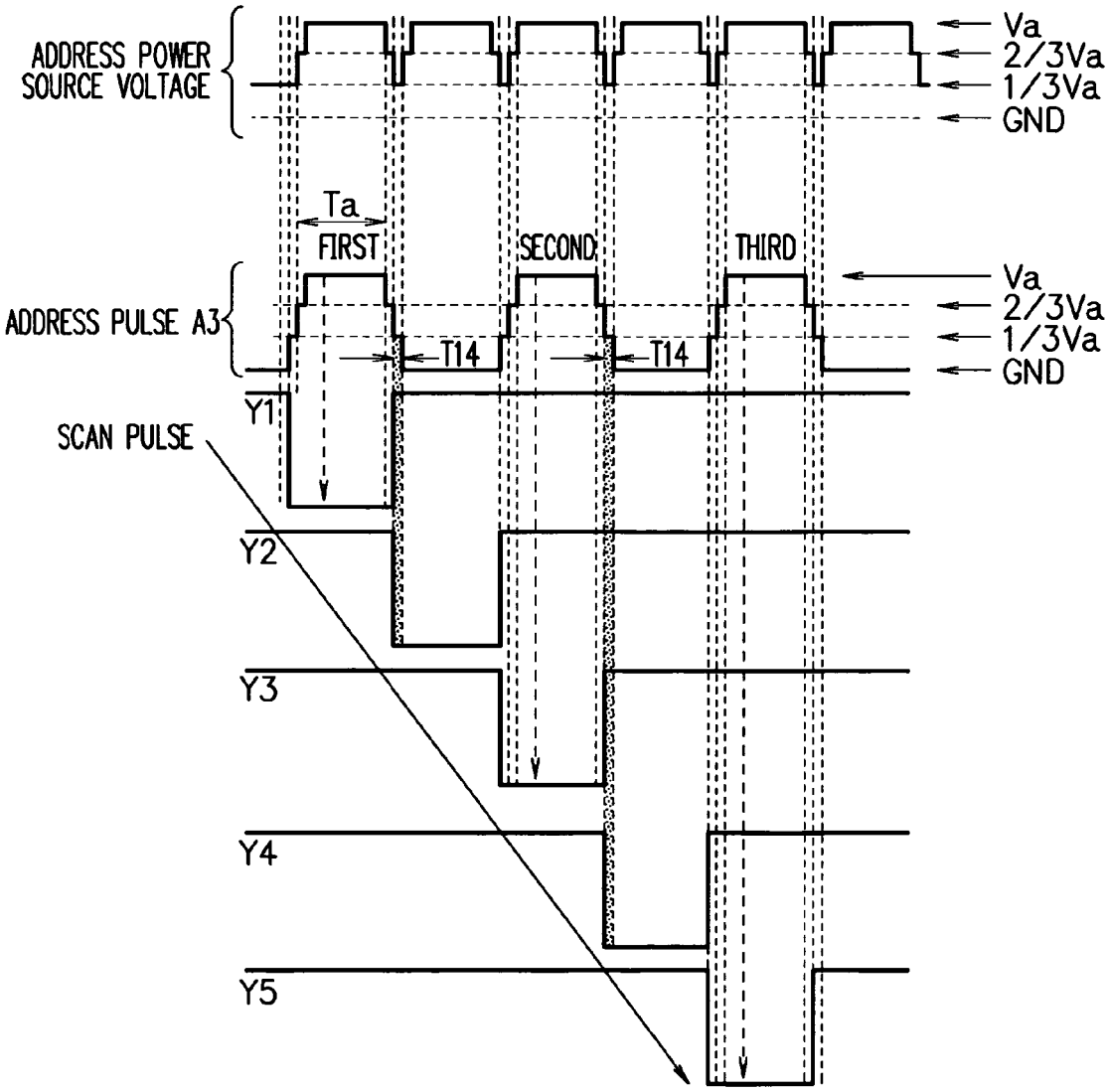
FIG. 14 is a chart showing an address pulse to an address electrode and scan pulses to Y electrodes according to an eighth embodiment of the present invention.

FIG. 14 is a chart showing an address pulse to an address electrode Aj and scan pulses to Y electrodes Yi according to an eighth embodiment of the present invention. In this drawing, the timing of a three-stage address pulse is different from that in FIG. 12. In FIG. 12, the period T12 during which the address pulse falls overlaps the scan pulse to the Y electrode Y4, but in this embodiment, a period T14 during which an address pulse to an address electrode A3 sustains a voltage Va/3 one-stage higher than a lowest voltage GND overlaps a scan pulse to a Y electrode Y4 immediately subsequent to a scan pulse to a Y electrode Y3 corresponding to the address pulse.

As an example, the address pulse to the address electrode A3 corresponding to the scan pulse to the Y electrode Y3 will be described. When the scan pulse to the Y electrode Y3 falls, the address pulse rises from the ground GND to the voltage Va/3 and sustains the voltage Va/3. Thereafter, the address pulse rises from the voltage Va/3 to a voltage 2Va/3 and sustains the voltage 2Va/3. Thereafter, the address pulse rises from the voltage 2Va/3 to a voltage Va and sustains the voltage Va. Thereafter, the address pulse falls from the voltage Va to the voltage 2Va/3 and sustains the voltage 2Va/3. Thereafter, when the address pulse falls from the voltage 2Va/3 to the voltage Va/3, the scan pulse to the Y electrode Y3 rises. Thereafter, the address pulse falls from the voltage Va/3 to the ground GND and sustains the ground GND.

The period T14 during which the address pulse sustains the voltage Va/3 one-stage higher than the lowest voltage GND at the fall time overlaps the scan pulse to the Y electrode Y4 immediately subsequent to the scan pulse to the Y electrode Y3 corresponding to the address pulse. Consequently, a period Ta during which the address pulse sustains the highest voltage Va is made longer, allowing stable address discharge. Incidentally, in the period T14, the voltage Va/3 of the address pulse is low, so that no erroneous address discharge occurs to the Y electrode Y4. Therefore, according to this embodiment, as in the sixth and seventh embodiments, the three-stage address pulse makes it possible to achieve both reduction in power consumption and stable address discharge.

Ninth Embodiment

Figure 15:
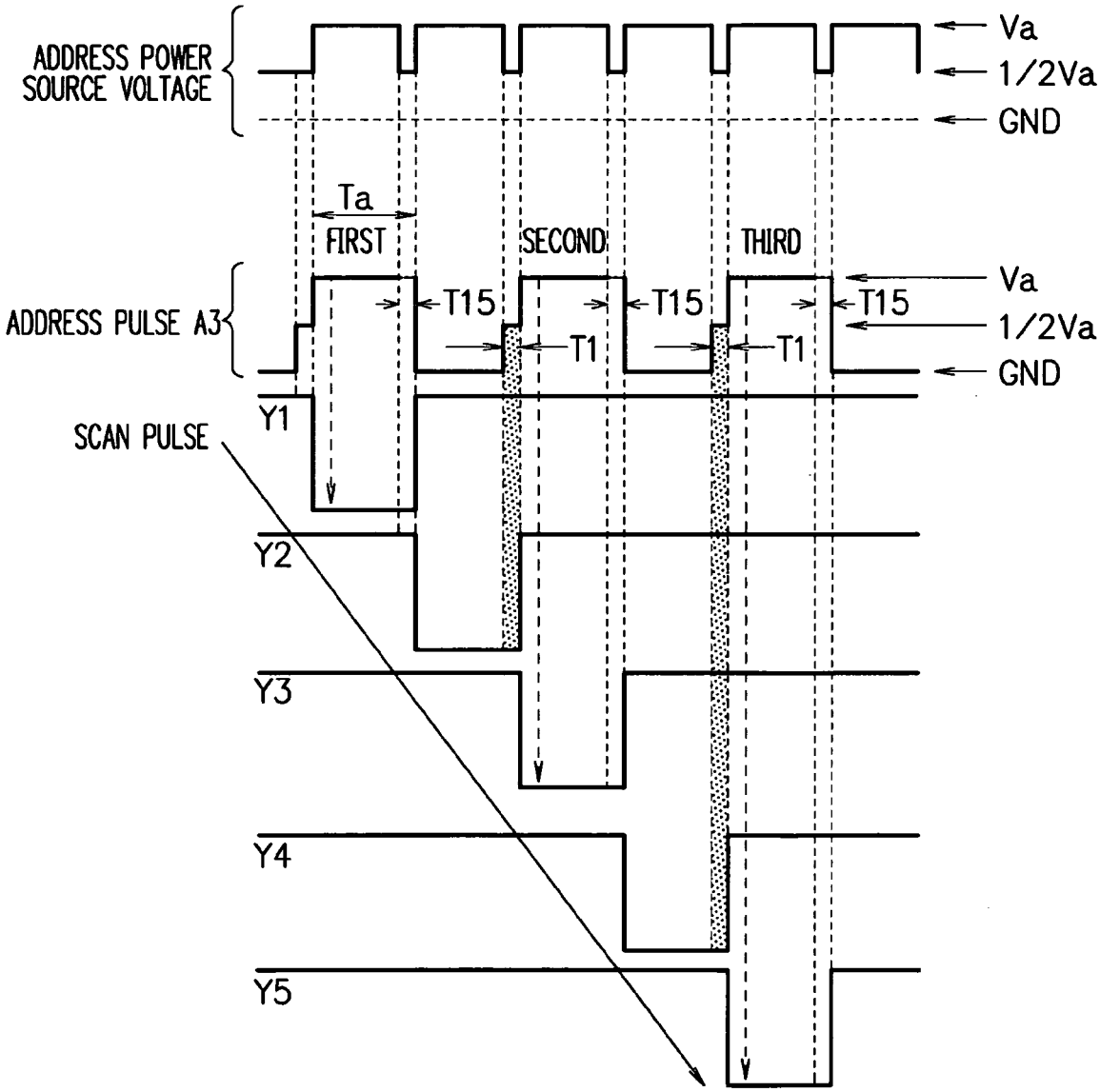
FIG. 15 is a chart showing an address pulse to an address electrode and scan pulses to Y electrodes according to a ninth embodiment of the present invention.

FIG. 15 is a chart showing an address pulse to an address electrode Aj and scan pulses to Y electrodes Yi according to a ninth embodiment of the present invention. This drawing is different from FIG. 7 in that the address pulse falls in one stage. In this embodiment, the address pulse falls in one stage from a highest voltage Va to a lowest voltage GND. A period T15 corresponds to the period during which the address pulse sustains the voltage Va/2 in FIG. 7, and in this embodiment, an address electrode A3 is kept in a high-impedance state during this period T15. Owing to the high-impedance state, the address pulse does not fall to an address power source voltage Va/2, so that a voltage Va can be sustained. Details thereof will be described later with reference to FIG. 18A and FIG. 18B.

According to this embodiment, the address pulse rises in two stages and falls in one stage. In this embodiment, as in the first embodiment, the address pulse makes it possible to achieve both reduction in power consumption and stable address discharge, compared to the case in FIG. 6. Incidentally, this embodiment does not include the power recovery at the time the address pulse falls, so that power consumption is higher than that in the first embodiment. However, in this embodiment, a period Ta during which the address pulse sustains a highest voltage Va is longer than that in the first embodiment, allowing stable address discharge.

Tenth Embodiment

Figure 16B:
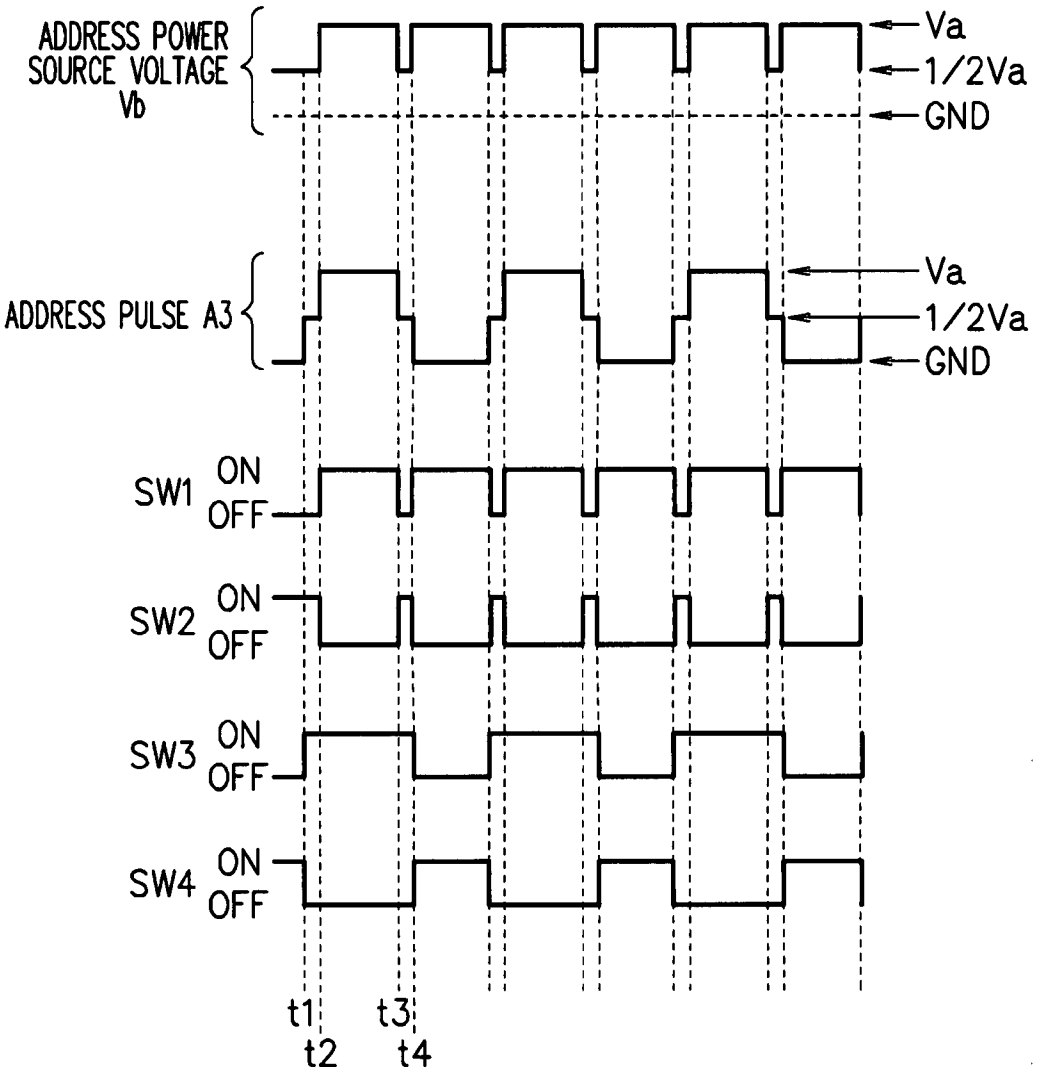
FIG. 16A and FIG. 16B are charts showing a tenth embodiment of the present invention.
Figure 16A:
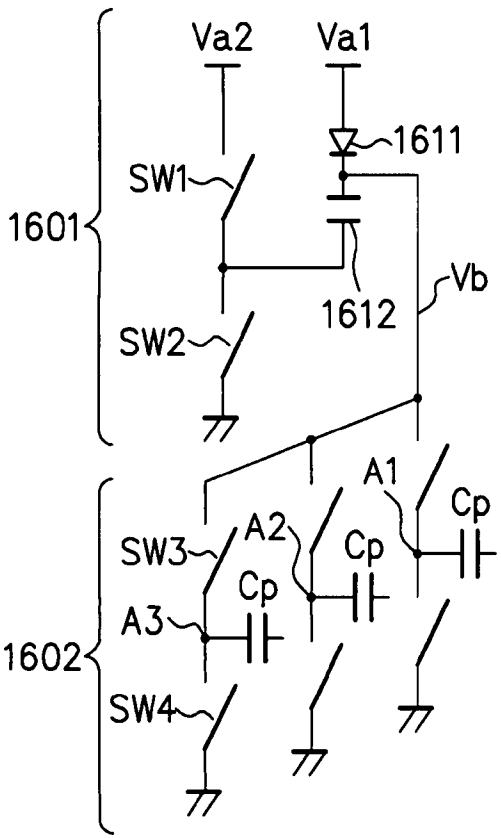

FIG. 16A and FIG. 16B are charts showing a tenth embodiment of the present invention. FIG. 16A is a circuit diagram showing a structural example of the address driving circuit 6 (FIG. 1) for generating the address pulses of the first to fourth embodiments, and FIG. 16B is a timing chart to illustrate operations of the circuit. Note that FIG. 16B shows an example of the address pulses in the first and second embodiments.

First, the structure of the address driving circuit shown in FIG. 16A will be described. The address driving circuit has a power source circuit 1601 and an address driver 1602. In the first and second embodiments, a voltage Va1 and a voltage Va2 are the voltage Va/2. In the third and fourth embodiments, the voltage Va1=Va/4 and the voltage Va2=3Va/4.

A switch SW1 is connected between the voltage Va2 and a lower end of a capacitance 1612. A switch SW2 is connected between the lower end of the capacitance 1612 and the ground. A diode 1611 is connected to the voltage Va1 at its anode and connected to an upper end of the capacitance 1612 at its cathode. A voltage of the cathode of the diode 1611 is an address power source voltage Vb.

A switch SW3 is connected between the cathode of the diode 1611 and the address electrode A3. A switch SW4 is connected between the address electrode A3 and the ground. The address electrode A3 is connected to the X electrodes Xi and the Y electrodes Yi via a panel capacitance Cp. Each of the other address electrodes A1, A2, and so on is also connected to the cathode of the diode 1611 and the ground via two switches similarly to the address electrode A3.

Next, the operations of the circuit shown in FIG. 16A will be described with reference to FIG. 16B. Before a time t1, the switch SW1 is off, the switch SW2 is on, the switch SW3 is off, and the switch SW4 is on. Since the switch SW 4 is on, the voltage of the address electrode A3 is the ground GND.

Next, at the time t1, the switch SW3 turns on and the switch SW4 turns off. The capacitance 1612 is charged with the voltage Va1, so that the address power source voltage Vb and the voltage of the address electrode A3 change to the voltage Va1 (for example, Va/2).

Next, at a time t2, the switch SW1 turns on and the switch SW2 turns off. The address power source voltage Vb and the voltage of the address electrode A3 change to a voltage Va1+Va2 (for example, Va).

Next, at a time t3, the switch SW1 turns off and the switch SW2 turns on. The address power source voltage Vb and the voltage of the address electrode A3 fall to the voltage Va1. The power of the address electrode A3 is recovered in the capacitance 1612.

Next, at a time t4, the switch SW1 turns on, the switch SW2 turns off, the switch SW3 turns off, and the switch SW4 turns on. The voltage of the address electrode A3 changes to the ground GND. The address power source voltage Vb changes to the voltage Va1+Va2 (for example, Va). Thereafter, the above-described operations are repeated, so that the address pulse can be generated.

Eleventh Embodiment

Figure 17B:
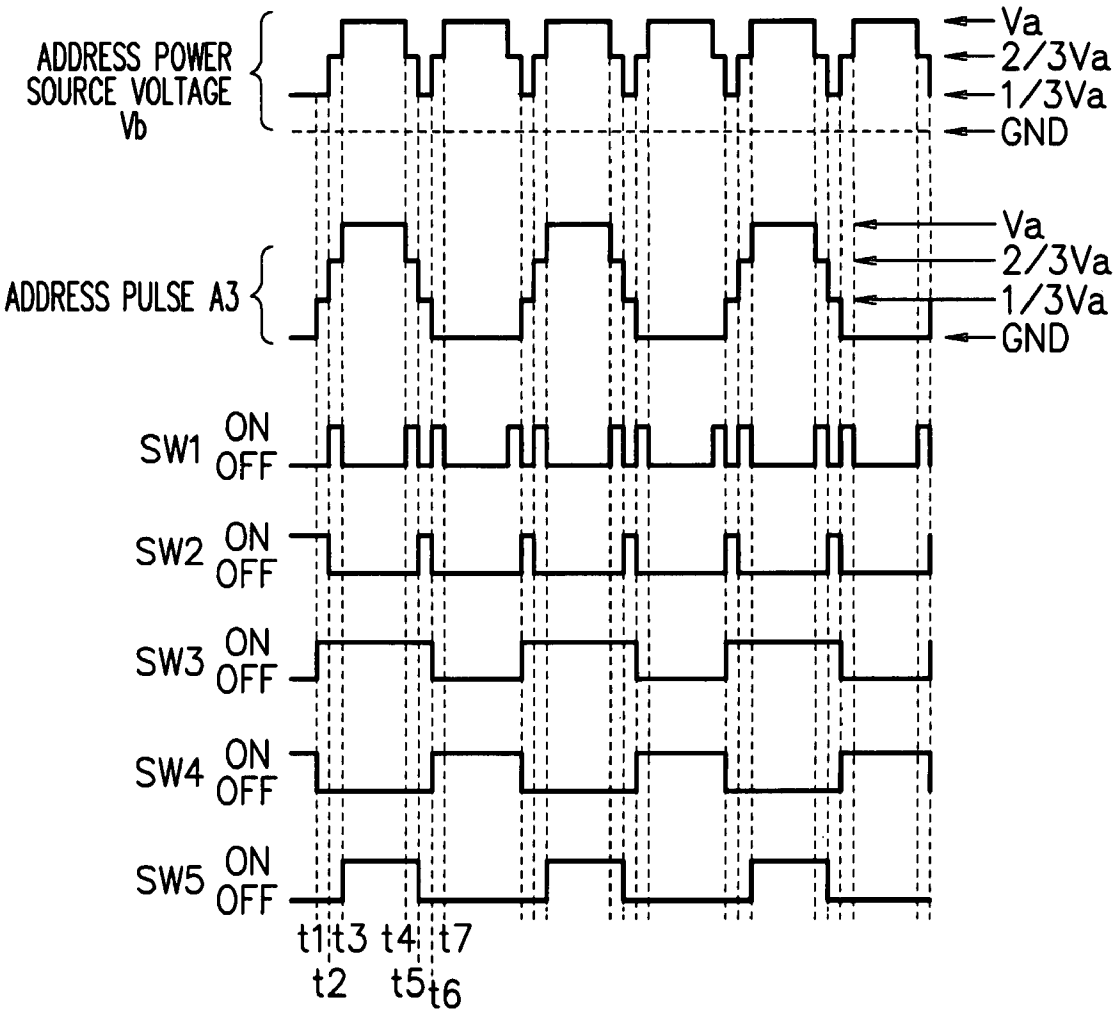
FIG. 17A and FIG. 17B are charts showing an eleventh embodiment of the present invention.
Figure 17A:
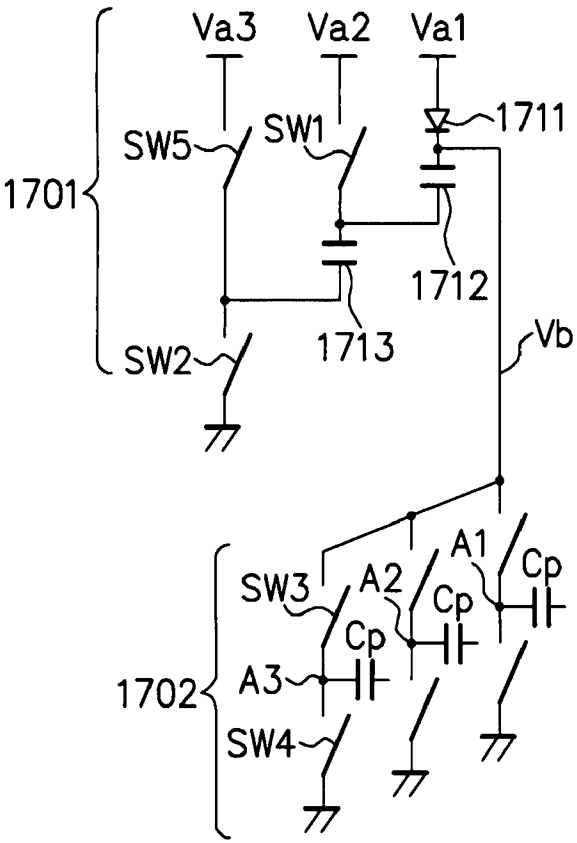

FIG. 17A and FIG. 17B are charts showing an eleventh embodiment of the present invention. FIG. 17A is a circuit diagram showing a structural example of the address driving circuit 6 (FIG. 1) for generating the address pulses of the fifth to eighth embodiments, and FIG. 17B is a timing chart to illustrate the operations of the circuit.

First, the structure of the circuit shown in FIG. 17A will be described. The address driving circuit has a power source circuit 1701 and an address driver 1702. A voltage Va1=Va2=Va3=Va/3. A switch SW5 is connected between the voltage Va3 and a lower end of a capacitance 1713. A switch SW2 is connected between the lower end of the capacitance 1713 and the ground. A switch SW1 is connected between the voltage Va2 and an upper end of the capacitance 1713. A diode 1711 is connected to the voltage Va1 at its anode and connected to an upper end of a capacitance 1712 at its cathode. A lower end of the capacitance 1712 is connected to the upper end of the capacitance 1713. A voltage of the cathode of the diode 1711 is an address power source voltage Vb. The address driver 1702 has the same structure as that of the address driver 1602 shown in FIG. 16A.

Next, the operations of the circuit shown in FIG. 17A will be described with reference to FIG. 17B. Before a time t1, the switch SW1 is off, the switch SW2 is on, the switch SW3 is off, the switch SW4 is on, and the switch SW5 is off. Since the switch SW4 is on, the voltage of the address electrode A3 becomes the ground GND.

Next, at the time t1, the switch SW3 turns on and the switch SW4 turns off. The address power source voltage Vb and the voltage of the address electrode A3 change to the voltage Va1 (=Va/3).

Next, at a time t2, the switch SW1 turns on and the switch SW2 turns off. The address power source voltage Vb and the voltage of the address electrode A3 change to a voltage Va1+Va2 (=2Va/3).

Next, at a time t3, the switch SW1 turns off and the switch SW5 turns on. The address power source voltage Vb and the voltage of the address electrode A3 change to a voltage Va1+Va2+Va3 (=Va).

Next, at a time t4, the switch SW1 turns on. The address power source voltage Vb and the voltage of the address electrode A3 change to 2Va/3. The power of the address electrode A3 is recovered in the capacitances 1712 and 1713.

Next, at a time t5, the switch SW1 turns off, the switch SW2 turns on, and the switch SW5 turns off. The address power source voltage Vb and the voltage of the address electrode A3 change to Va/3. The power of the address electrode A3 is recovered in the capacitances 1712 and 1713.

Next, at a time t6, the switch SW1 turns on, the switch SW2 turns off, the switch SW3 turns off, and the switch SW4 turns on. The voltage of the address electrode A3 changes to the ground GND and the address power source voltage Vb changes to 2Va/3.

Next, at a time t7, the switch SW1 turns off. The voltage of the address electrode A3 sustains the ground GND and the address power source voltage Vb changes to Va. Thereafter, the above-described operations are repeated, so that the address pulse can be generated.

Twelfth Embodiment

Figure 18B:
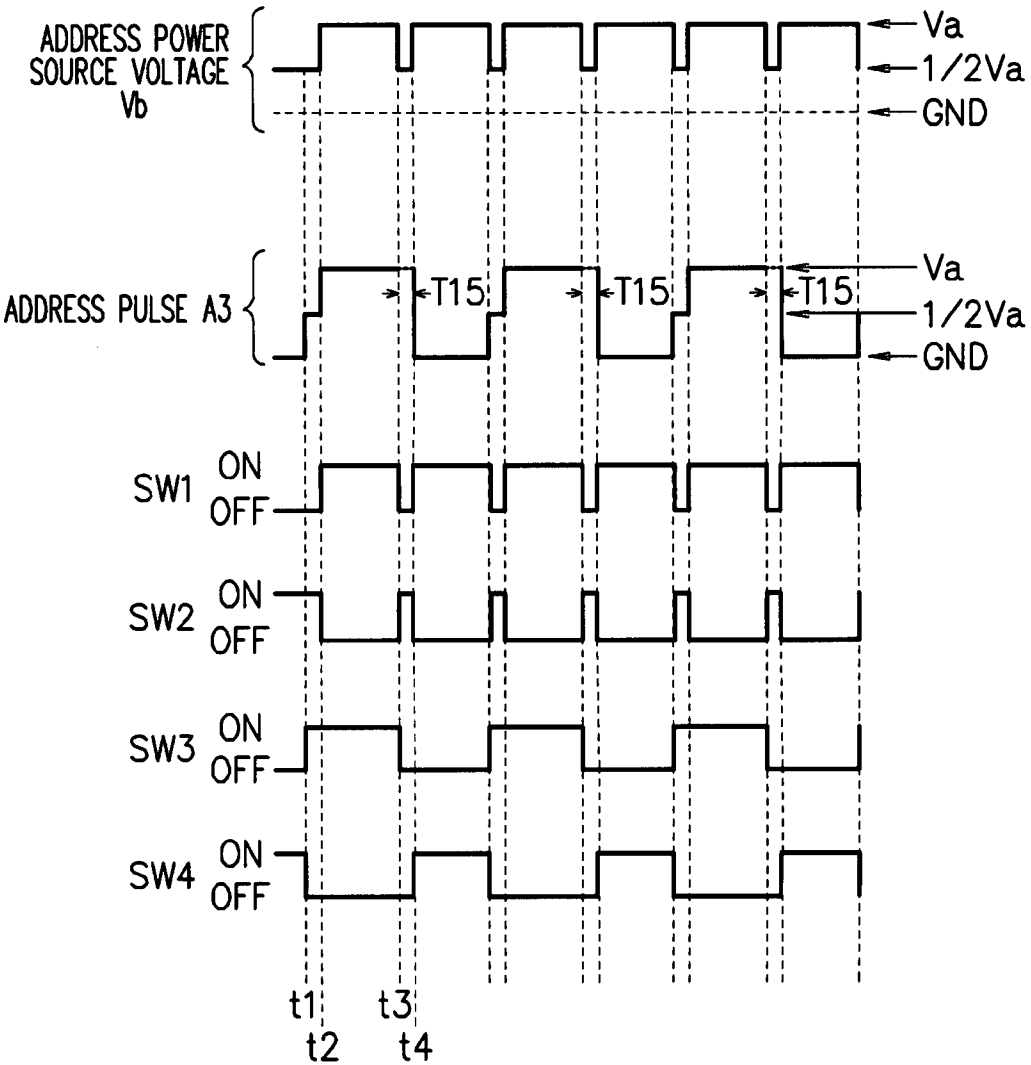
FIG. 18A and FIG. 18B are charts showing a twelfth embodiment of the present invention.
Figure 18A:
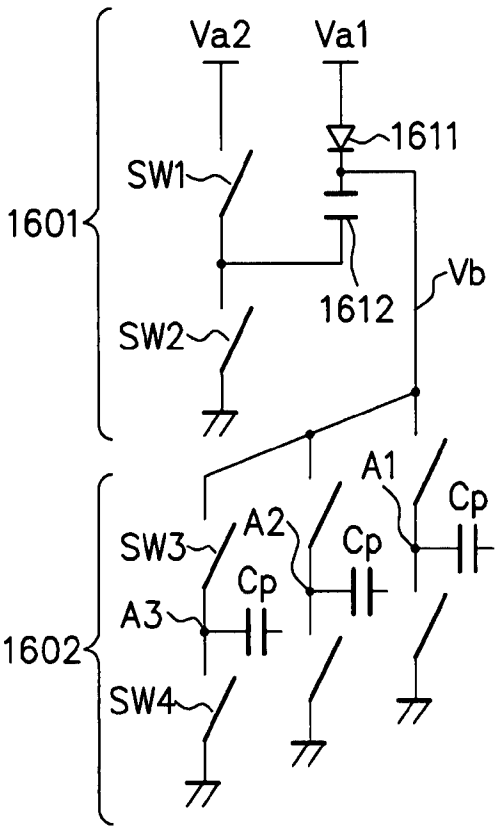

FIG. 18A and FIG. 18B are charts showing a twelfth embodiment of the present invention. FIG. 18A is a circuit diagram showing a structural example of the address driving circuit 6 (FIG. 1) for generating the address pulse of the ninth embodiment, and FIG. 18B is a timing chart to illustrate the operations of the circuit. The circuit configuration shown in FIG. 18A is the same as that shown in FIG. 16A. A voltage Va1=Va2=Va/2.

The operations of the circuit shown in FIG. 18A will be described with reference to FIG. 18B. Operations at a time t1 and a time t2 are the same as those in FIG. 16B. Thereafter, at a time t3, a switch SW1 turns off, a switch SW2 turns on, and a switch SW3 turns off. The address electrode A3 is put into a high-impedance state to sustain the voltage Va. The address power source voltage Vb changes to Va/2.

Next, at a time t4, the switch SW1 turns on, the switch SW2 turns off, and a switch SW4 turns on. The voltage of the address electrode A3 changes to the ground GND and the address power source voltage Vb changes to Va. Thereafter, the above-described operations are repeated, so that the address pulse can be generated.

Hitherto, the first to twelfth embodiments have described the examples where the address pulse rises and falls in two stages or in three stages, but it may rise and fall in four stages or more. The address pulse rises in n stages (n is an integer equal to or larger than 2). A predetermined period in the period during which the address pulse rises from the lowest voltage to the highest voltage (for example, the period during which a voltage one-stage higher than the lowest voltage is sustained) overlaps a scan pulse immediately prior to the scan pulse corresponding to the address pulse. Further, the address pulse falls in n stages (n is an integer equal to or larger than 2). A predetermined period in the period during which the address pulse falls from the highest voltage to the lowest voltage (for example, the period during which a voltage one-stage higher than the lowest voltage is sustained) overlaps a scan pulse immediately subsequent to the scan pulse corresponding to the address pulse. This can extend the period Ta during which the address pulse sustains the highest voltage Va, allowing stable address discharge. Further, the n-stage address pulse makes it possible to reduce power consumption.

Moreover, in the first, second, and fifth to eighth embodiments, when the address pulse rises from the lowest voltage to the highest voltage in n stages, a displacement voltage at each rise of the n stages is 1/n of a difference voltage between the lowest voltage and the highest voltage. Similarly, when the address pulse falls in n stages from the highest voltage to the lowest voltage, a displacement voltage at each fall of the n stages is 1/n of the difference voltage between the lowest voltage and the highest voltage.

In the third and fourth embodiments, a displacement voltage differs depending on each rise stage of the address pulse. The displacement voltage when it rises from the lowest voltage to the one-stage higher voltage is lower than the displacement voltage at the other stage. When this is applied to the three-stage address pulse, the displacement voltage at the first stage is less than Va/3, and the displacement voltages at the second and third stages are equal to each other and higher than Va/3. In short, the displacement voltages at part (the second stage and the third stage) of the respective rise stages of the address pulse are equal and that at the other part thereof is different.

The same applies to the fall time. Specifically, the displacement voltages at the respective fall stages of the address pulse are different, and the displacement voltage when the address pulse falls from the voltage one-stage higher than the lowest voltage to the lowest voltage is lower than the displacement voltage at the other stage. Further, the displacement voltages at part of the respective fall stages of the address pulse are equal and that at the other part thereof is different.

Raising an address pulse in n stages makes it possible to reduce power consumption. Further, a period during which a voltage one-stage higher than the lowest voltage is sustained overlaps a scan pulse immediately prior to the scan pulse corresponding to the address pulse, so that a period during which the address pulse sustains the highest voltage can be made longer, allowing stable selection of a display pixel.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A plasma display device comprising:

a plurality of scan electrodes sequentially scanned to be impressed with a scan pulse;

an address electrode that is impressed with an address pulse corresponding to the scan pulse, for selection of a display pixel;

a scan driving circuit generating the scan pulse; and an address driving circuit generating the address pulse, wherein the address pulse falls in n stages (n is an integer equal to or larger than 2) and a period in a period during which the address pulse falls from a highest voltage to a lowest voltage overlaps a scan pulse immediately subsequent to the scan pulse corresponding to the address pulse.

2. The plasma display device according to claim 1, wherein the period is a period during which a voltage one-stage higher than the lowest voltage is sustained.

3. The plasma display device according to claim 2, wherein a period during which the address pulse sustains a voltage one-stage lower than the highest voltage and falls from the voltage one-stage lower than the highest voltage to the lowest voltage overlaps a scan pulse immediately subsequent to the scan pulse corresponding to the address pulse.

4. The plasma display device according to claim 1, wherein the address pulse falls in two stages, and a voltage one-stage higher than the lowest voltage of the address pulse is substantially ½ of the highest voltage of the address pulse.

5. The plasma display device according to claim 1, wherein the address pulse falls in two stages, and a voltage one-stage higher than the lowest voltage of the address pulse is less than ½ of the highest voltage of the address pulse.

6. The plasma display device according to claim 1, wherein, when the address pulse falls in n stages from the highest voltage to the lowest voltage, a displacement voltage at each fall stage in the n stages is 1/n of a difference voltage between the lowest voltage and the highest voltage.

7. The plasma display device according to claim 1, wherein a displacement voltage when the address pulse falls from a voltage one-stage higher than the lowest voltage to the lowest voltage is lower than a displacement voltage when the address pulse falls at the other stage.

8. The plasma display device according to claim 1, wherein the address pulse rises in n stages, and a period during which the address pulse rises from the lowest voltage to a voltage one-stage lower than the highest voltage and sustains the voltage one-stage lower than the highest voltage overlaps a scan pulse corresponding to said period.

* * * * *

UNITED STATES PATENT AND TRADEMARK OFFICE

CERTIFICATE OF CORRECTION

PATENT NO. : 7,576,712 B2
APPLICATION NO. : 11/302520
DATED : August 18, 2009
INVENTOR(S) : Akihiro Takagi et al.

It is certified that error appears in the above-identified patent and that said Letters Patent is hereby corrected as shown below:

Column 14, Line 11, change "equal to or larger than 2) and a period in a period during" to --equal to or larger than 2) and a period is a period during--.

Signed and Sealed this

Sixteenth Day of March, 2010

David J. Kappos

David J. Kappos
*Director of the United States Patent and Trademark Office*